US010053880B2

(12) United States Patent
Melic

(10) Patent No.: US 10,053,880 B2
(45) Date of Patent: Aug. 21, 2018

(54) LOCKING AND PIVOTING LATCH FOR A FENCE SUPPORT POST

(71) Applicant: Jonathan J. Melic, Stoney Creek, CA (US)

(72) Inventor: Jonathan J. Melic, Stoney Creek, CA (US)

( * ) Notice: Subject to any disclaimer, the term of this patent is extended or adjusted under 35 U.S.C. 154(b) by 764 days.

(21) Appl. No.: 14/404,859

(22) PCT Filed: May 31, 2013

(86) PCT No.: PCT/CA2013/000528
§ 371 (c)(1),
(2) Date: Dec. 1, 2014

(87) PCT Pub. No.: WO2013/177682
PCT Pub. Date: Dec. 5, 2013

(65) Prior Publication Data

US 2015/0176304 A1 Jun. 25, 2015

Related U.S. Application Data

(60) Provisional application No. 61/654,134, filed on Jun. 1, 2012.

(51) Int. Cl.
*E04G 21/32* (2006.01)
*E04G 25/04* (2006.01)
(Continued)

(52) U.S. Cl.
CPC ..... *E04G 25/04* (2013.01); *E04G 21/3233* (2013.01); *E04H 17/161* (2013.01); *E04H 17/20* (2013.01); *E04G 2005/148* (2013.01)

(58) Field of Classification Search
CPC ..... E01F 13/00; E01F 13/046; E04F 11/06; E04F 11/068; E04F 11/1865;
(Continued)

(56) References Cited

U.S. PATENT DOCUMENTS 2,806,723 A * 9/1957 Fairclough ..... A47B 9/08 248/188.5
4,733,844 A * 3/1988 Molloy ..... E04F 21/1805 248/354.1
(Continued)

FOREIGN PATENT DOCUMENTS

CN 101243232 A 8/2008
CN 102102460 A 6/2011
(Continued)

OTHER PUBLICATIONS

Supplemental European Search Report for Application No. 13797775.7 dated Apr. 11, 2016.
(Continued)

*Primary Examiner* — Josh Skroupa
(74) *Attorney, Agent, or Firm* — Honigman Miller Schwartz and Cohn LLP

(57) ABSTRACT

A support post comprising first and second elongate members, a ceiling engaging member at the upper end of the first elongate member and a floor engaging member at the lower end of the second elongate member. A spring biases the ceiling engaging member away from the upper end of the first elongate member. A lock maintains the spring in a compressed configuration. When in its unlocked position the lock releases the spring and permits it to apply a biasing force to the ceiling engaging member, urging the ceiling engaging member away from the upper end of the first elongate member. A latch is secured to the first elongate member and permits telescopic movement between the elongate members when said lock is in its locked position. The latch engages the second elongate member when the lock is in its unlocked position and resists relative telescopic movement between the elongate members.

17 Claims, 35 Drawing Sheets

(51) Int. Cl.
*E04H 17/20* (2006.01)
*E04H 17/16* (2006.01)
*E04G 5/14* (2006.01)

(58) Field of Classification Search
CPC .... E04F 2011/187; E04G 5/142; E04G 21/32; E04G 21/3233; E04G 25/04; E04G 2005/148; E04G 2025/045; E04H 14/161; E04H 14/20; E04H 14/22
USPC ..... 256/24, 67
See application file for complete search history.

(56) References Cited

U.S. PATENT DOCUMENTS

| | | | | |
|---|---|---|---|---|
| 4,761,092 | A | | 8/1988 | Nakatani |
| 4,928,916 | A | | 5/1990 | Molloy |
| 5,352,001 | A | | 10/1994 | Shieh |
| 5,988,963 | A | | 11/1999 | Shiau |
| 6,050,531 | A | | 4/2000 | Wilcox |
| 6,409,412 | B1 | * | 6/2002 | Huang ..... F16B 2/246 248/188.5 |
| 6,851,652 | B1 | * | 2/2005 | Huang ..... E04G 25/06 248/200.1 |
| 8,152,118 | B2 | | 4/2012 | Melic |

FOREIGN PATENT DOCUMENTS

| | | | | |
|---|---|---|---|---|
| FR | 2347509 | A * | 12/1977 | ..... E04G 21/3233 |
| FR | 2827921 | A1 * | 1/2003 | ..... F16B 2/246 |
| JP | H084321 | A | 1/1996 | |
| WO | WO-2007016785 | A2 | 2/2007 | |

OTHER PUBLICATIONS

Chinese Office Action for Application No. 201380040440.3 with English translation thereof.
International Search Report PCT/CA2013/000528 dated Sep. 17, 2013.

* cited by examiner

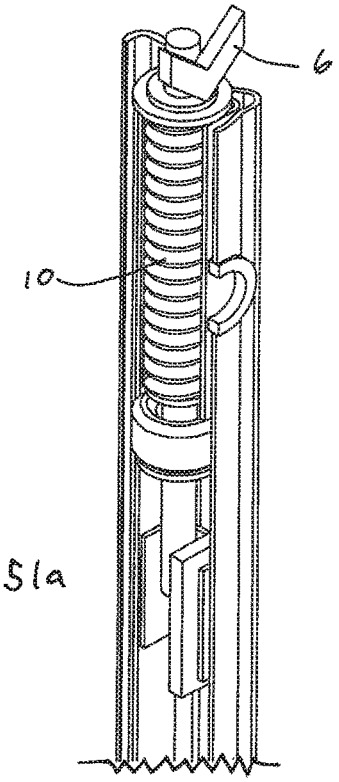
Fig 51a
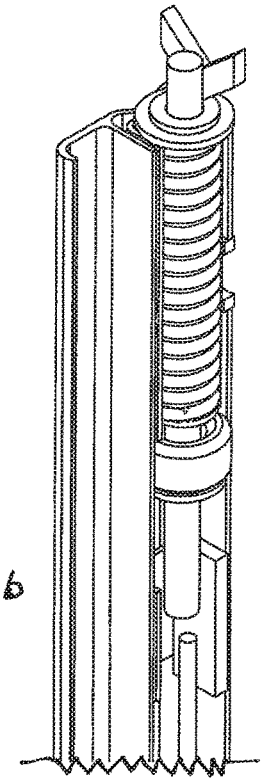
Fig 51b
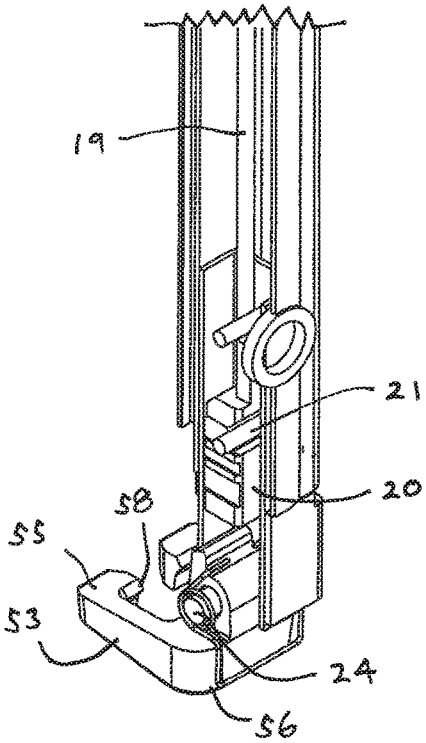
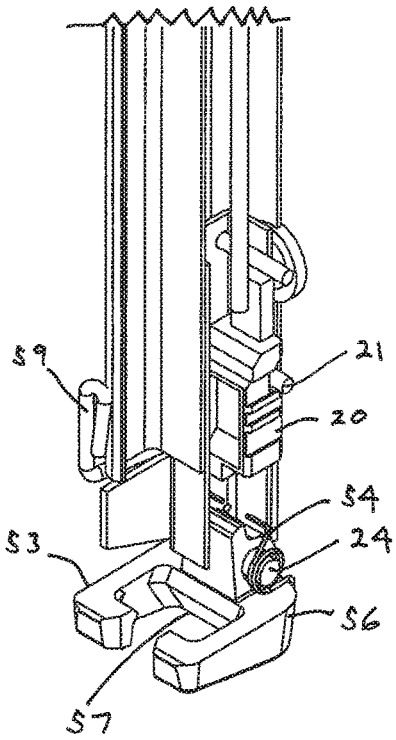

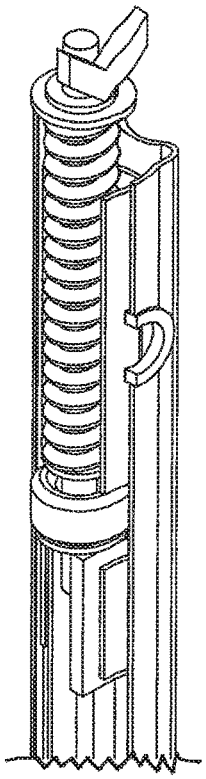
Fig 52 a
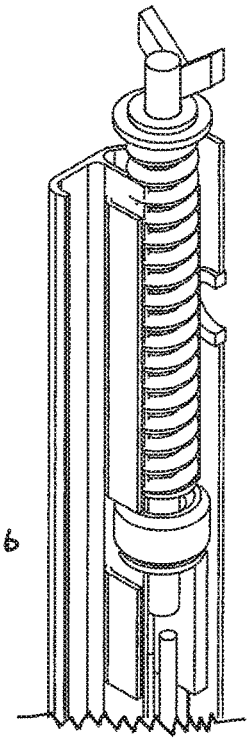
Fig 52 b
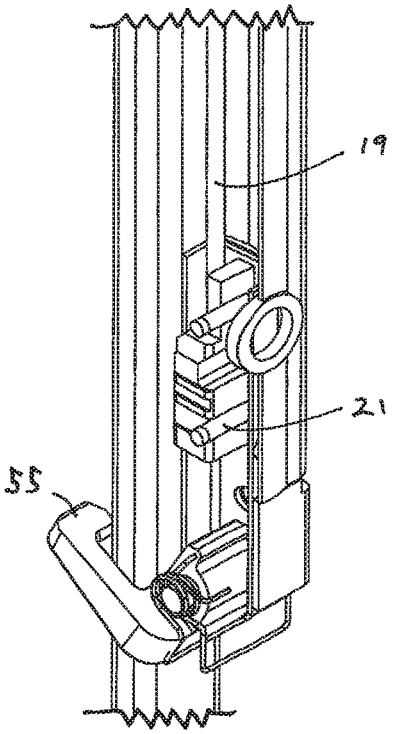
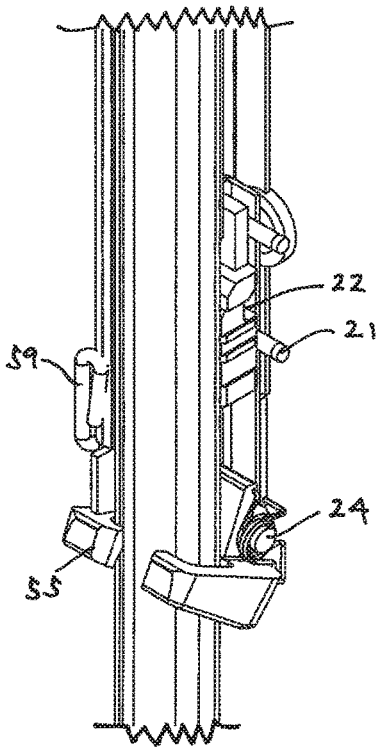

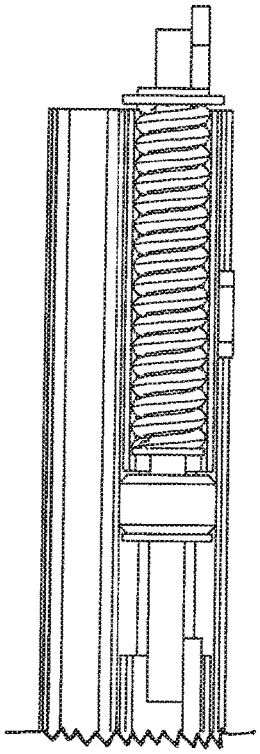
Fig 53
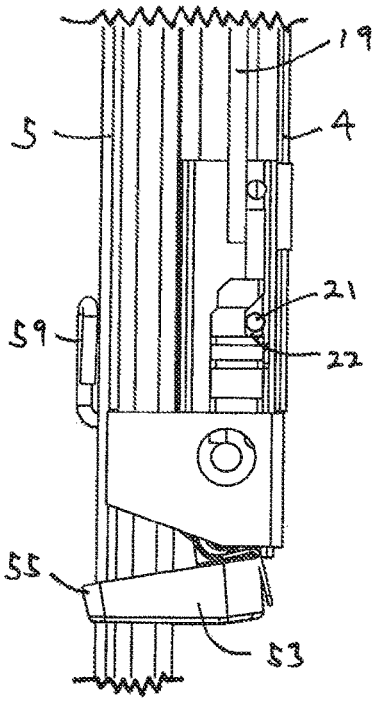
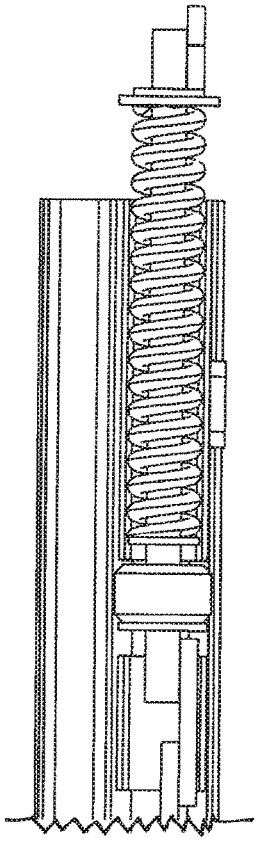
Fig 54
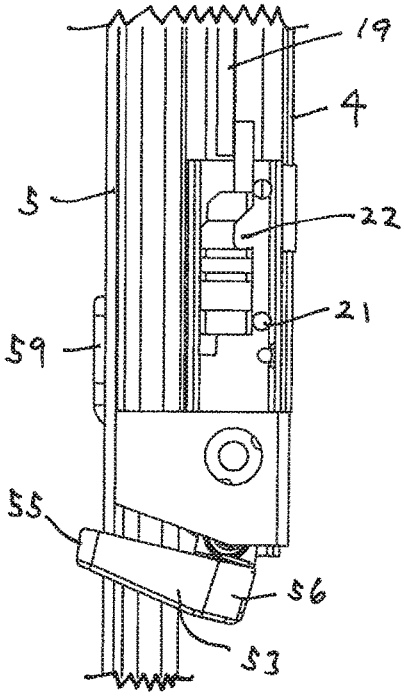

LOCKING AND PIVOTING LATCH FOR A FENCE SUPPORT POST

FIELD

The field relates generally to support posts, combined fence panels and support posts, and components for use in association with safety fences or safety barriers and the like.

BACKGROUND

The construction of modern multi-floor buildings often requires temporary barriers to be erected about the building's perimeter on each floor until exterior walls or cladding can be installed. Such barriers help to ensure the safety of construction personnel and also the safety of passersby on the ground through preventing construction material and debris from being blown or otherwise falling from a building while under construction. Ideally, such barriers should be capable of withstanding a predetermined load and should be both easy to install and easy to dismantle. In multi-floor high-rise construction, safety barriers will typically be moved from floor to floor as the exterior walls are constructed. Commonly, the barriers are supported between the concrete or wooden floor systems and the ceiling system directly above.

Others have proposed a wide variety of different support posts and other components for use in association with safety barriers or safety fences. Existing support posts have been used to retain safety barriers on multi-floor construction sites, however, a number suffer from particular inherent deficiencies and limitations. For example, currently available support posts may be cumbersome to install, may be expensive to manufacture, may be easily intentionally or accidentally unlocked or dislodged, or may not be easily removed and transported to different floors for re-installation. Currently available safety barriers or safety fences also typically require adjacent fence panels to be wired together or attached to one another through the use of, in some instances, frail, cumbersome or inefficient clamps or fastening mechanisms. There is a continuing need to improve the support posts and components used in association with a safety barrier or safety fence.

SUMMARY

In one aspect there is provided a support post for releasably securing between a ceiling structure and a floor structure, the support post comprising first and second elongate members, one of said first and second elongate members telescopically received about at least a portion of the other, a ceiling engaging member positioned at the upper end of said first elongate member and a floor engaging member positioned at the lower end of said second elongate member, a spring biasing said ceiling engaging member in a direction away from said upper end of said first elongate member, a lock, when in its locked position said lock maintaining said spring in a compressed configuration and when in its unlocked position said lock releasing said spring from its compressed configuration and permitting said spring to apply a biasing force to said ceiling engaging member urging said ceiling engaging member away from said upper end of said first elongate member, a latch operatively secured to said first elongate member, said latch allowing for the telescopic movement of said first elongate member relative to said second elongate member when said lock is in said locked position, said latch engaging said second elongate member when said lock is in said unlocked position and resisting the telescopic movement of said first elongate member relative to said second elongate member.

There is also provided a fence panel having an integrated support post, the support post for releasably securing between a ceiling structure and a floor structure, the fence panel including a frame, said support post including a first elongate member telescopically received about at least a portion of a second elongate member, said second elongate member comprising at least a portion of the frame of said fence panel.

In a further aspect there is provided a support post for releasably securing between a ceiling structure and a floor structure, the support post comprising a first elongate member telescopically mounted to a second elongate member that comprises a portion of a fence panel, a ceiling engaging member positioned at the upper end of said first elongate member and a floor engaging member positioned at the lower end of said second elongate member, a spring biasing said ceiling engaging member in a direction away from said upper end of said first elongate member, a lock, when in its locked position said lock maintaining said spring in a compressed configuration and when in its unlocked position said lock releasing said spring from its compressed configuration and permitting said spring to apply a biasing force to said ceiling engaging member urging said ceiling engaging member away from said upper end of said first elongate member, and a latch, said latch allowing for the telescopic movement of said first elongate member relative to said second elongate member when said lock is in said locked position, said latch resisting the telescopic movement of said first elongate member relative to said second elongate member when said lock is in its unlocked position.

In a further aspect there is provided a support post for releasably securing between two rigid or semi-rigid structures, the support post comprising first and second elongate members, one of said first and second elongate members telescopically received about at least a portion of the other, said first elongate member having a first structural engaging member and said second elongate member having a second structural engaging member, a spring biasing said first structural engaging member in a direction away from the outer end of said first elongate member, a lock, having a locked and an unlocked position, when in its locked position said lock maintaining said spring in a compressed configuration and when in its unlocked position said lock releasing said spring from its compressed configuration and permitting said spring to apply a biasing force to at least one of said first and second structural engaging members urging said at least one structural engaging member away from its respective elongate member, and a latch operatively secured to one of said first and second elongate members, said latch allowing for the telescopic movement of said elongate members relative to one another when said lock is in said locked position, said latch resisting the telescopic movement of said elongate members relative to one another when said lock is in said unlocked position.

There is also provided a fence lock for releasably securing a fence panel to an adjacent fence panel or other structure, the fence lock comprising a central body slidably received over a structural member of the fence panel; and, at least one arm secured to said central body in an orientation such that the longitudinal axis of said arm is generally parallel to the longitudinal axis of said central body, said arm having a free end releasably securable to an adjacent fence panel or other structure.

There is further provided a fence lock for releasably securing a first fence panel to an adjacent second fence panel, the fence lock comprising a central body slidably receivable over a structural member of the first fence panel; and a pair of arms secured to said central body in an orientation such that the longitudinal axes of said arms are generally parallel to the longitudinal axis of said central body, each of said arms having a free end, said free ends directed opposite to one another, at least one of said free ends of said arms releasably securable to an adjacent fence panel or other structure.

BRIEF DESCRIPTION OF THE DRAWINGS

For a better understanding reference will now be made, by way of example, to the accompanying drawings which show exemplary embodiments of the present invention in which:

FIG. 13*a* is an enlarged detail view of portion "A" of FIG. 13.

FIG. 13*b* is a view similar to FIG. 13*a* wherein the fence lock of the vertically oriented safety barrier has been received within the fence lock receiver of the horizontally oriented safety barrier.

FIG. 51*a* is a side perspective longitudinal sectional view of the support post shown in FIG. 50 in its locked position.

FIG. 51*b* is a side perspective longitudinal sectional view from an opposite direction to that shown in FIG. 51*a* .

FIG. 52*a* is side perspective longitudinal sectional view of the support post shown in FIG. 50 in its unlocked position.

FIG. 52*b* is a side perspective longitudinal sectional view from an opposite direction to that shown in FIG. 52*a*.

FIG. 53 is a side sectional view of the support post of FIG. 50 shown in its locked position.

FIG. 54 is a side sectional view of the support post of FIG. 50 in its unlocked position.

DESCRIPTION

Figures 1, 1A:
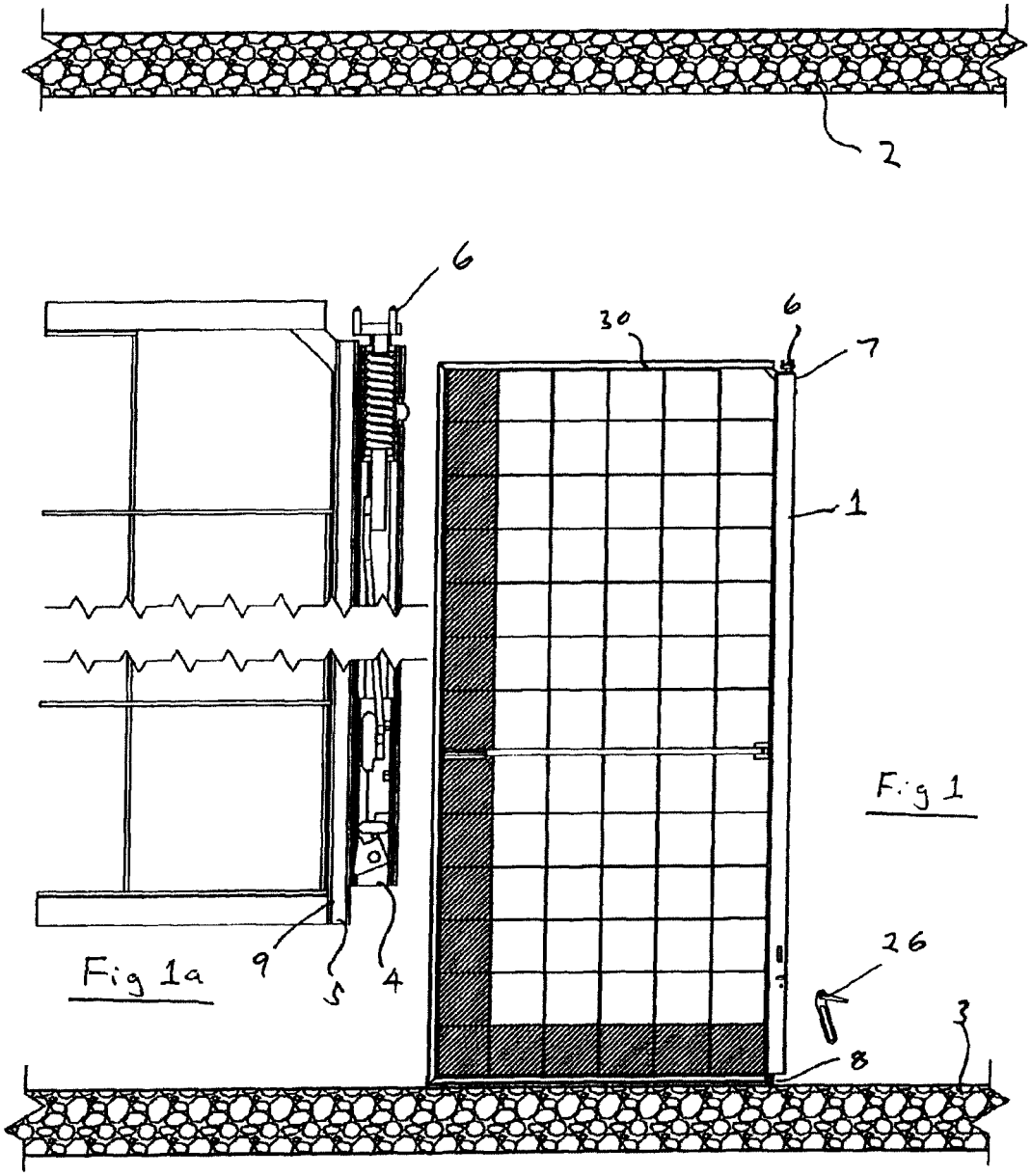
FIG. 1 is an exterior view of a support post constructed in accordance with one of the embodiments of the invention shown attached to a safety barrier frame.
FIG. 1*a* is an enlarged rear cutaway view of the support post shown in FIG. 1.

The present invention may be embodied in a number of different forms. The specification and drawings that follow describe and disclose some of the specific forms.

In the attached figures there is shown embodiments wherein a support post is noted generally by reference numeral 1. Support post 1 is designed primarily for releasably securing between a ceiling structure 2 and a floor structure 3. It will, however, be appreciated by those having a thorough understanding of the embodiment shown that the ceiling structure 2 and floor structure 3 could be any of a wide variety of other rigid or relatively rigid structures and that they need not necessarily be a ceiling and a floor. That is, it will be understood that support post 1 could be mounted horizontally or at an angle between two walls or other rigid or semi-rigid structures or surfaces.

Support post 1 is comprised generally of first and second elongate members 4 and 5, respectively. One of elongate members 4 and 5 is telescopically received about the other. In the embodiment shown, first elongate member 4 is telescopically received about second elongate member 5. In other embodiments the opposite situation could be the case. First elongate member 4 could also be telescopically received about only a portion of the second elongate member (for example about the upper end of the second elongate member). Support post 1 further includes a first structural or ceiling engaging member 6 positioned at the upper end 7 of first elongate member 4 and a second structural or floor engaging member 8 positioned at the lower end 9 of the second elongate member 5. A spring 10 biases ceiling engaging member 8 in a direction away from upper end 7 of first elongate member 4. In the embodiment of the invention shown, spring 10 is a coil spring, however, other forms of springs, including spring or belleville washers could be used. In order to bias the ceiling engaging member away from the upper end of the first elongate member, one end of spring 10 bears against a first pin or support member 11 that is fixed within first elongate member 4, and the opposite end of the spring 10 bears against, directly or indirectly, ceiling engaging member 6. In the embodiment of the invention shown first pin or support member 11 is comprised of a washer or plate 12 secured to a sleeve 13 which is fixed within the upper end of the first elongate member by means of a pin 14 that extends into the sleeve and through the exterior surface of the first elongate member. The lower end of spring 10 thus bears against washer or plate 12, which is in turn rigidly fixed to the exterior surface of first elongate member 4. In the attached drawings, the upper end of spring 10 bears against a bushing 15, which in turn bears against and transmits the spring force to ceiling engaging member 6. As is known in the art, ceiling engaging member 6 may have any number of claws, sharpened points or knife-edge surfaces to enhance its ability to engage a ceiling or other surface.

Figure 2B:
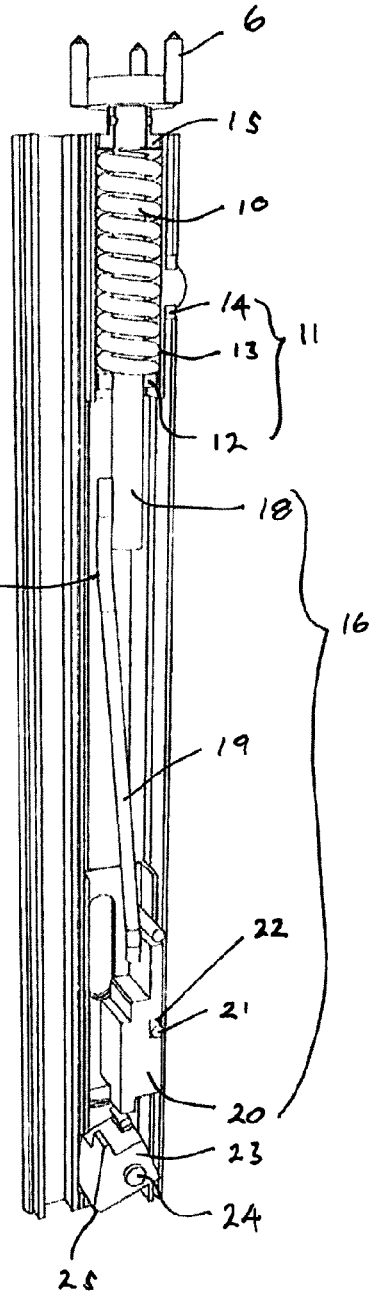
FIGS. 2*a* and 2*b* are enlarged detail longitudinal sectional views through the support post shown in FIG. 1.
Figure 2A:
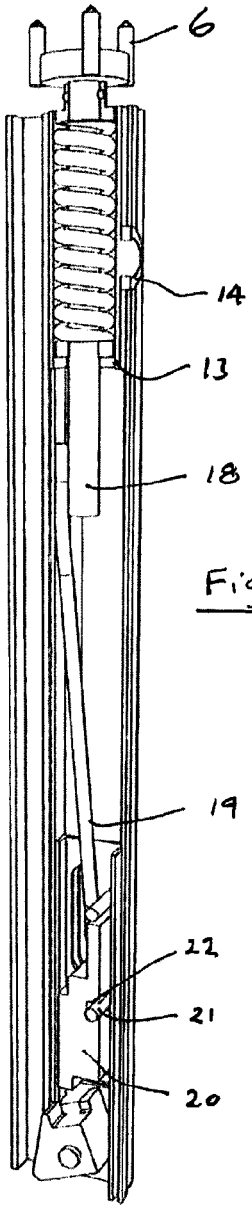

With reference to FIGS. 2*a* and 2*b*, support post 1 further includes a lock 16 that has a locked and unlocked position. When lock 16 is in its locked position the lock maintains spring 10 in a compressed configuration. When lock 16 is in its unlocked position the lock releases the spring from its compressed configuration and permits the spring to apply a biasing force to the ceiling engaging member, as generally described above. One form of lock 16 is shown in the attached drawings and described below. The lock could equally take on a various other structures.

Lock 16 includes a rod 17, that in the attached drawings is itself comprised of an upper rod 18 and a connecting rod 19. As will be appreciated from a thorough understanding of the function and structure discussed below, connecting rod 19 is preferably less rigid than upper rod 18 and will allow for a limited degree of horizontal deflection or displacement.

Upper rod 18 extends through the centre of spring 10 and is fixed to ceiling engaging member 6. The lower end of the connecting rod 19 is fixed to a lock body 20. Support post 1 further includes a lock retainer 21 that releasably engages lock body 20 in order to secure and maintain the lock in its locked position with spring 10 in a compressed configuration. When the lock body is disengaged from the lock retainer lock 16 reverts to its unlocked position with spring 10 permitted to apply a biasing force to ceiling engaging member 6. In one embodiment, lock retainer 21 is a pin, rigidly fixed to the first elongate member 4, and lock body 20 includes a lock receiver 22. Lock receiver 22 is comprised of a groove or channel that is generally shaped to correspond to pin 21 so that when the pin is received within the groove or channel the lock is maintained in its locked position. When the lock body is released from about pin 21 lock 16 will revert to its unlocked position. Of course, the relative positions of lock retainer 21 and lock receiver 22 could be reversed with the retainer forming part of the lock body and the receiver forming part of or secured to the first elongate member 4. A wide variety of other forms of retainers and receivers could equally be utilized.

In accordance with the above structure, when lock 16 is in its locked configuration it will, through operation of upper rod 18 and connecting rod 19, compress spring 10 and retain the spring in a compressed configuration through the receipt of lock receiver 22 about lock retainer 21. It is expected that in most applications spring 10 will be a high strength spring having a relatively high spring constant (for example, 30 KN, although other strength springs could also be used). It is also expected that the range of movement of spring 10 will in most instances be approximately plus or minus 30 millimetres. The action of the high strength spring will effectively cause the spring to "fire" ceiling engaging member 6 into ceiling structure 2. The high force by which the ceiling engaging member is driven into the ceiling structure helps to secure post 1 in place and also reduces the need for multiple claws or similar friction engaging elements.

In accordance with this embodiment, support post 1 further includes a latch 23 that is operatively secured to first elongate member 4. In the embodiment of the invention depicted in the attached drawings, latch 23 is pivotally mounted on a pin 24 rigidly secured to the first elongate member 4. As will be described in more detail later, latch 23 allows for the telescopic movement of first elongate member 4 relative to second elongate member 5 when lock 16 is in its locked position. When lock 16 is in its unlocked position latch 23 engages second elongate member 5 and resists telescopic movement between the two elongate members. To assist latch 23 in resisting telescopic movement of the two elongate members a knife-edge 25 preferably exists along the surface of the latch that contacts member 5. The exterior of first elongate member 4 adjacent to knife-edge 25 is removed or has a window or slot cut into it such that rotation of the latch about latch pin 24 will allow knife-edge 25 to come into contact with the exterior surface of second elongate member 5. When lock 16 is unlocked, and floor engaging member 8 positioned against a floor or other solid structure and ceiling engaging member 6 in contact with a ceiling or other rigid structure, spring 10 will effectively drive first elongate member 4 downwardly forcing latch 23 to rotate and drive knife-edge 25 into contact with the exterior surface of the second elongate member, biting into the second elongate member and resisting longitudinal movement between the two elongate members. The action of spring 10 (effectively attempting to drive the ceiling engaging member upwardly and the first elongate member 4 downwardly) enhances the engagement of knife-edge 25 into the exterior surface of second elongate member 5. Retracting spring 10 and moving lock 16 to its locked position will effectively remove the force that drives knife-edge into second elongate member 5, permitting the two elongate members to be moved telescopically relative to one another.

Figure 3:
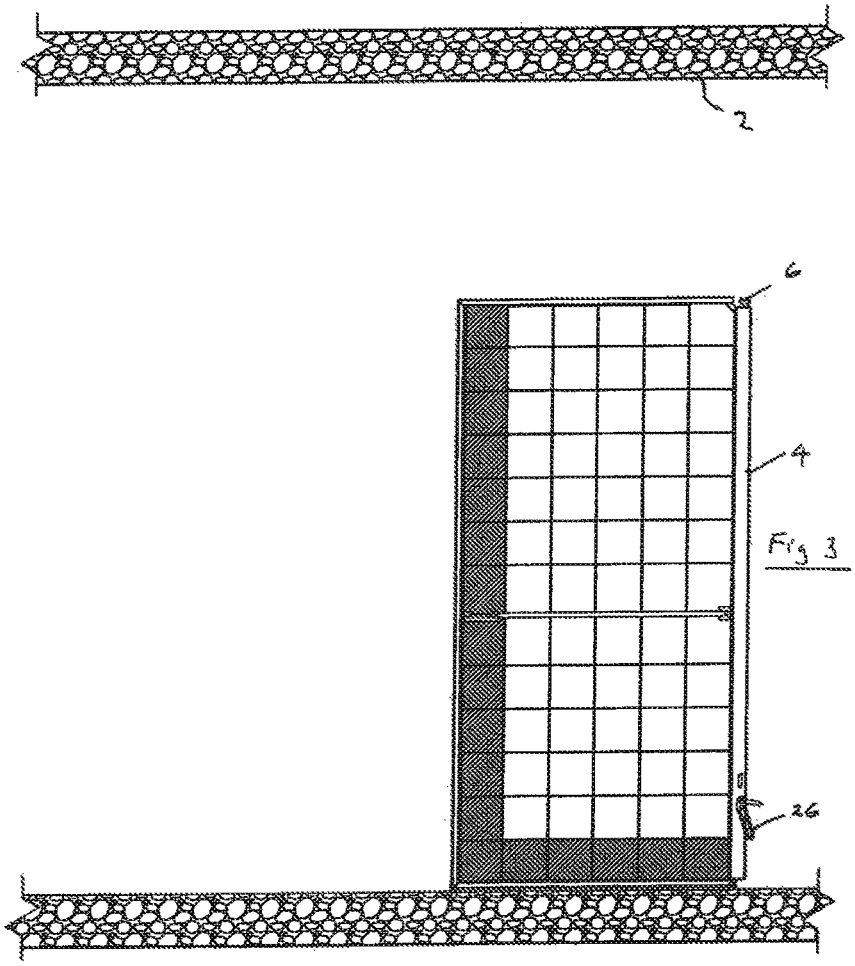
FIG. 3 is a view similar to FIG. 1 wherein a locking tool has been inserted into the support post for activation thereof.
Figure 3A:
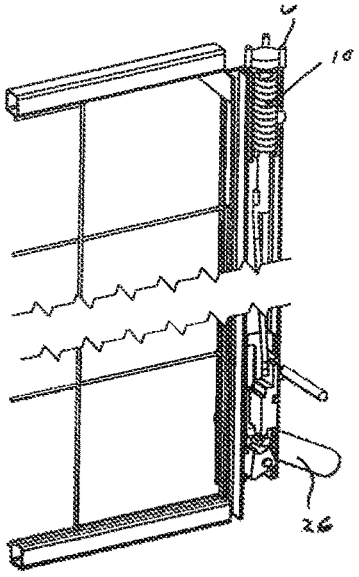
FIG. 3*a* is an enlarged rear detail longitudinal section view through the support post shown in FIG. 3.
Figures 4A, 4B:
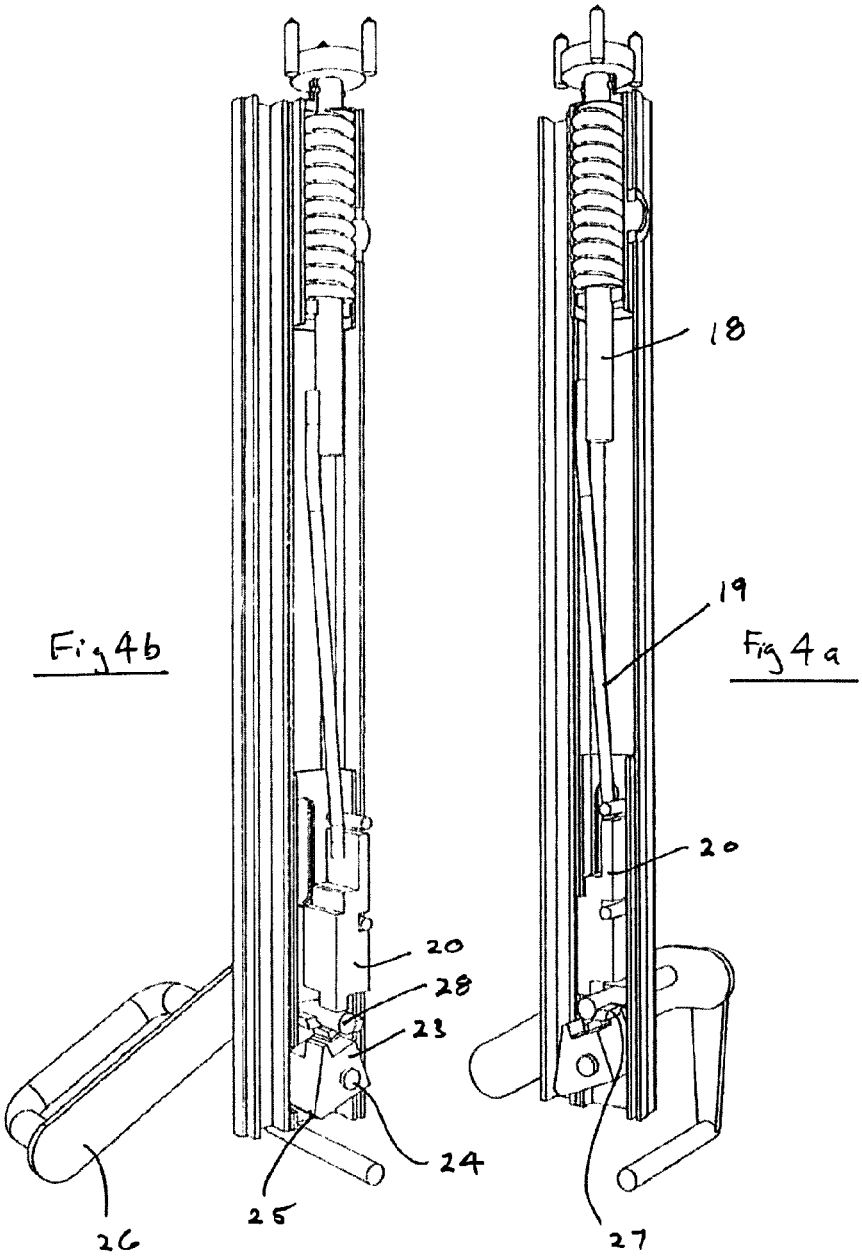
FIGS. 4*a* and 4*b* are enlarged detail longitudinal sectional views through the support post shown in FIG. 3*a*.

In an embodiment of the invention both first and second elongate members are tubular in nature having generally hollow interiors. In the case of the first elongate member 4, the dimensions of the interior are designed such that both lock 16 and latch 23 are preferably located within its hollow interior. In most instances it is also expected that much, if not all, of spring 10 and least a portion of ceiling engaging member 6 will also be retained within the hollow interior of first elongate member 4. In such a case, movement of the lock between its locked and unlocked positions will require the insertion of a tool 26 into the hollow interior of first elongate member 4. The operation of tool 26 is shown generally in FIGS. 3 through 10. In FIG. 3, support post 1 is shown in its disengaged configuration where spring 10 is compressed, lock 16 is held in its locked configuration by means of lock retainer 21 and lock receiver 22, and latch 23 is disengaged from second elongate member 5 permitting the two elongate members to be telescopically moved relative to one another. FIGS. 3, 3*a*, 4*a* and 4*b* show tool 26 having been inserted into the interior of a first elongate member 4 but not having yet been activated. Here, the lock remains in its locked position with the spring ready to "fire".

Figure 5:
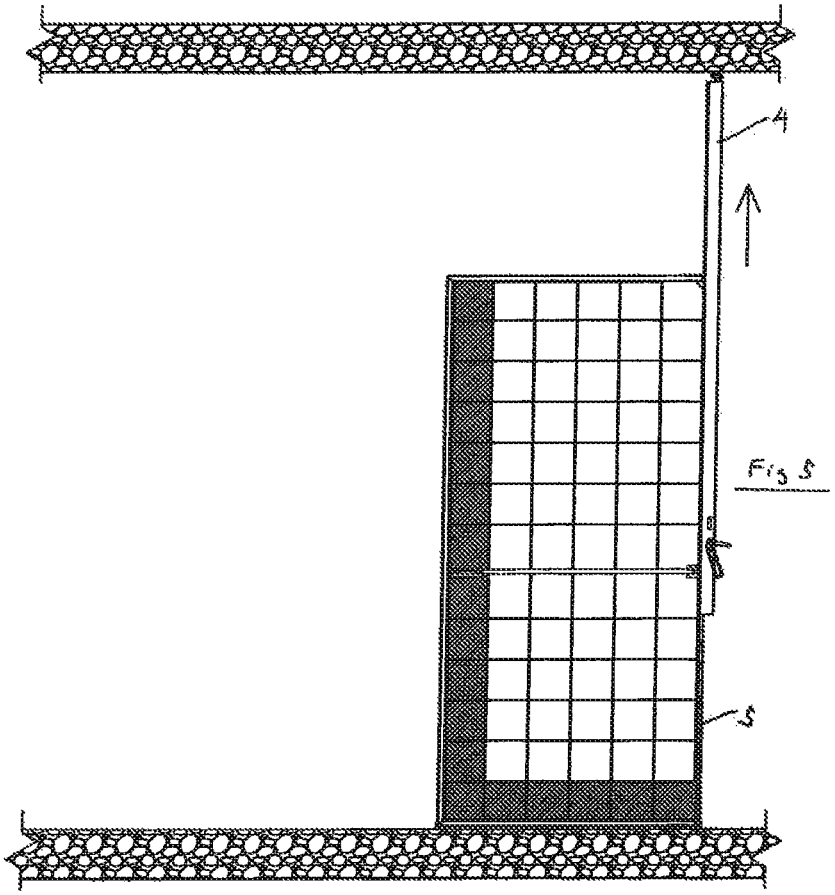
FIG. 5 is a view similar to FIG. 3 wherein the support post has been extended such that its upper end is in contact with the ceiling structure of the building.
Figure 5A:
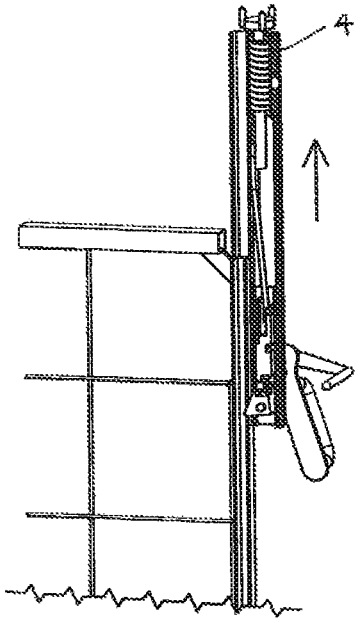
FIG. 5*a* is an enlarged rear detail longitudinal sectional view of the support post shown in FIG. 5.
Figure 6B:
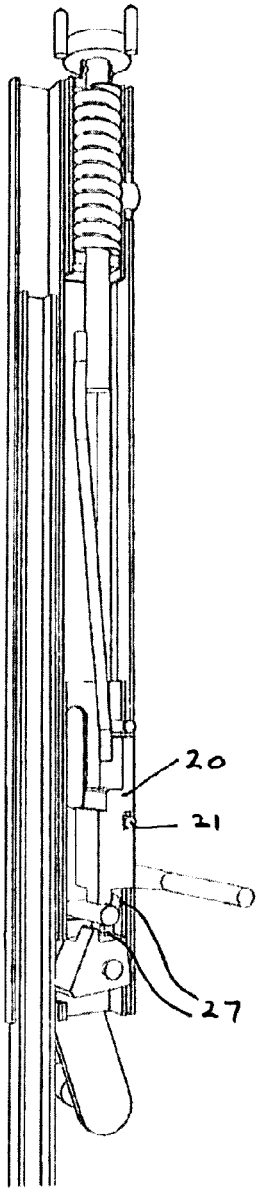
FIGS. 6*a* and 6*b* are enlarged detail longitudinal sectional views through the support post shown in FIG. 5*a*.
Figure 6A:
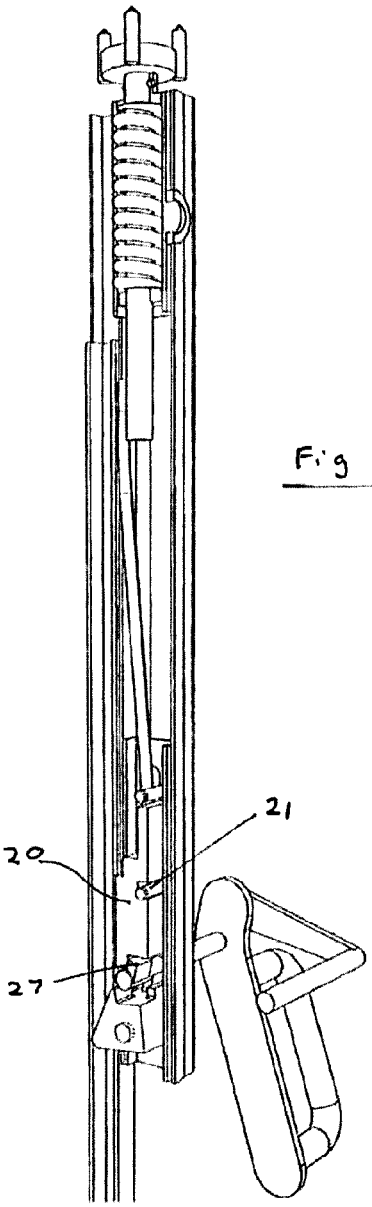
Figure 7:
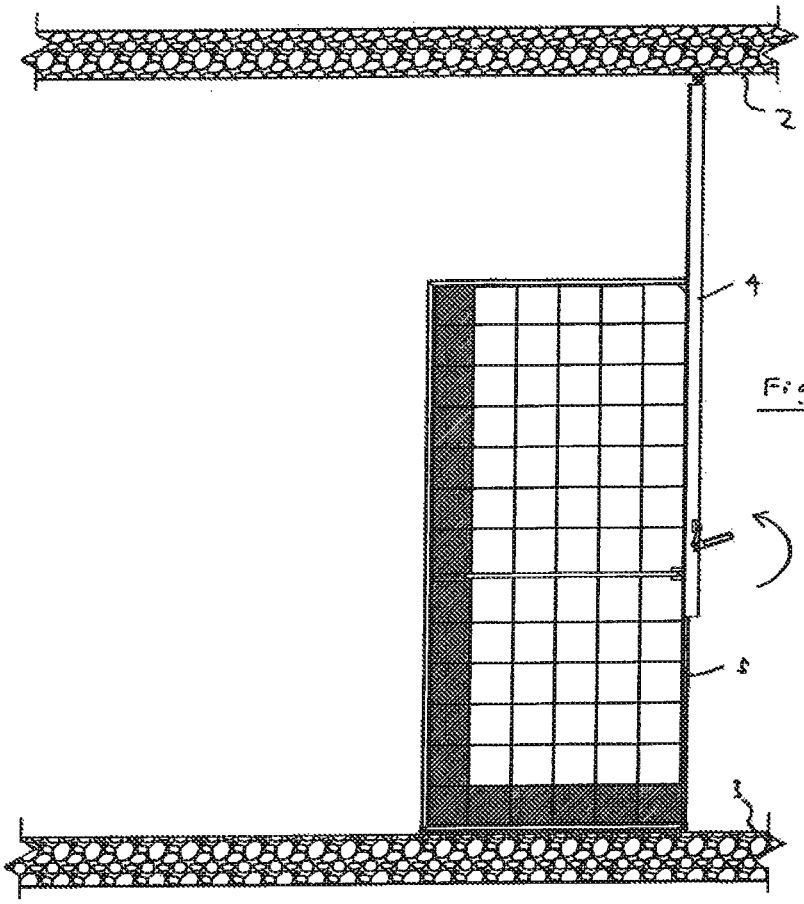
FIG. 7 is a view similar to FIG. 5 wherein the locking tool has been activated to lock the support post in place.
Figure 7A:
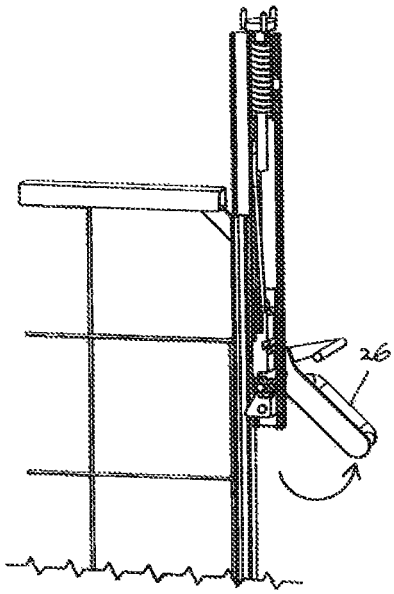
FIG. 7*a* is an enlarged detail rear longitudinal sectional view of the support post shown in FIG. 7.
Figure 8B:
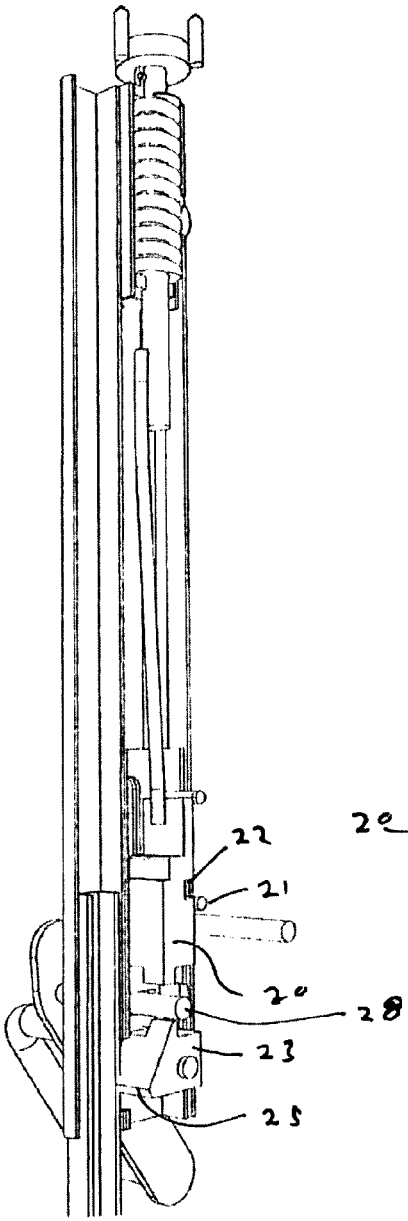
FIGS. 8*a* and 8*b* are enlarged detail longitudinal sectional views of the support post shown in FIG. 7*a*.
Figure 8A:
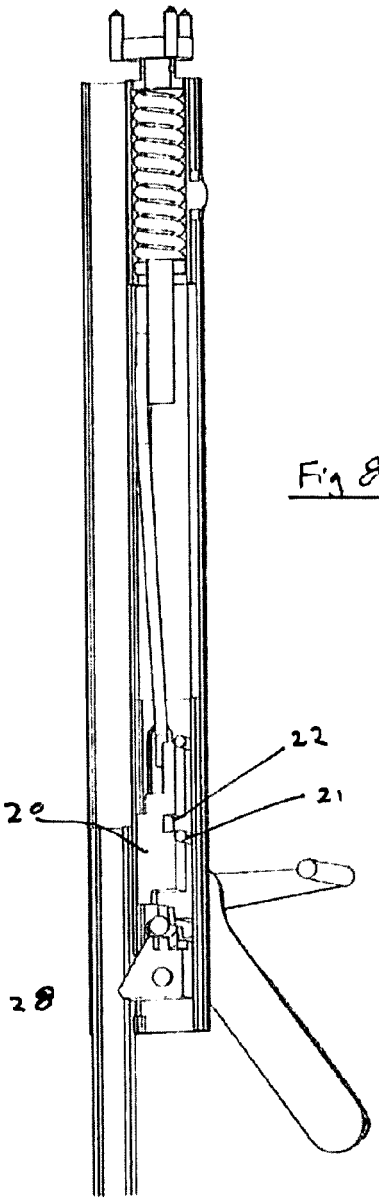

In FIGS. 5 and 5*a* first elongate member 4 has been moved upwardly relative to second elongate member 5 through grasping tool 26 and lifting it in a vertical direction. First elongate member 4 is lifted until ceiling engaging member 6 contacts ceiling structure 2, at which point rotation of the tool in a counter clockwise direction causes keys 27 on the tool shaft to rotate and contact both lock body 20 and latch 23. The lock body is urged away from lock retainer 21 while latch 23 is slightly rotated to enable knife-edge 25 to come into contact with the exterior surface of second elongate member 5. The continued rotation of the tool releases the lock body from the lock retainer and activates (fires) the spring to apply pressure to ceiling engaging member 6, effectively driving the ceiling engaging member into ceiling structure 2. At the same time that the spring drives ceiling engaging member 6 upwardly it will create a reactionary force attempting to drive first elongate member 4 downwardly, which has the effect of enhancing the bite of knife-edge 25 into the surface of second elongate member 50. At this point (see FIGS. 7, 8*a* and 8*b*), the spring will have "fired", ceiling engaging member 6 will have been driven into ceiling structure 2 and the two elongate members will be fixed in place relative to one another by the action of latch 23.

Figure 9:
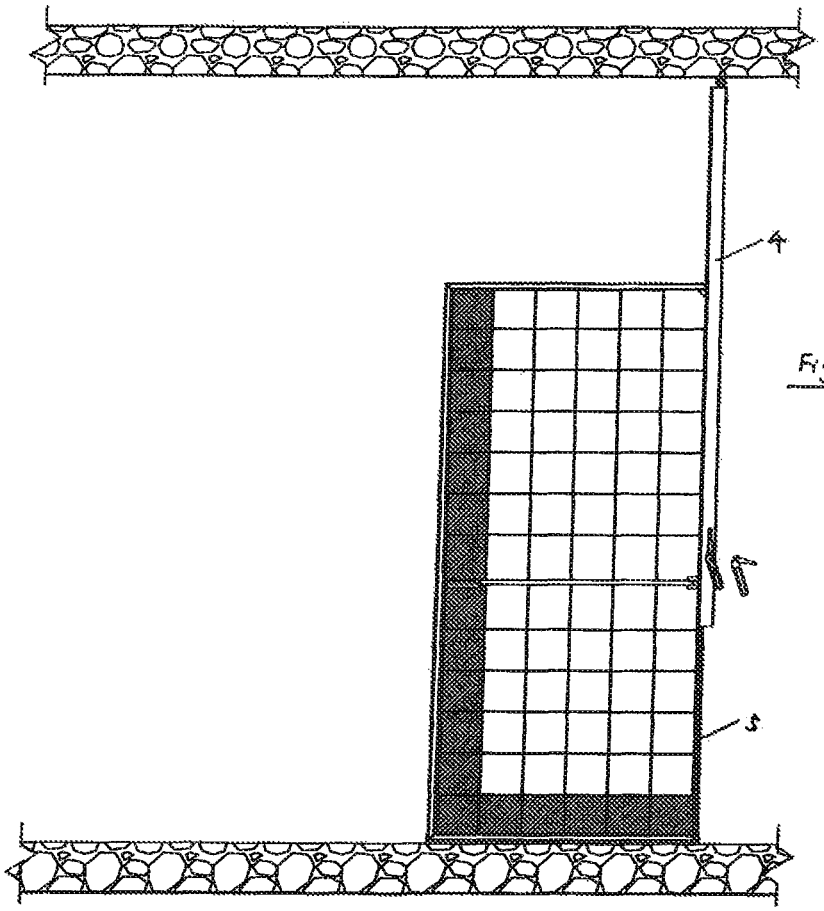
FIG. 9 is a view similar to FIG. 7 wherein the support post is in its locked position and the locking tool is being inserted to unlock and dismantle the post.
Figure 9A:
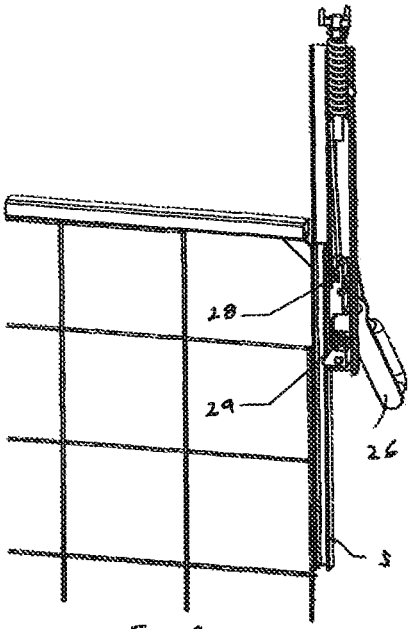
FIG. 9*a* is an enlarged detail longitudinal sectional view of the support post shown in FIG. 9.
Figure 9B:
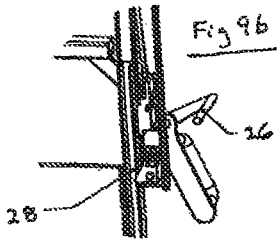
FIG. 9*b* is an enlarged detail view of the locking mechanism shown in FIG. 9*a*.
Figure 10:
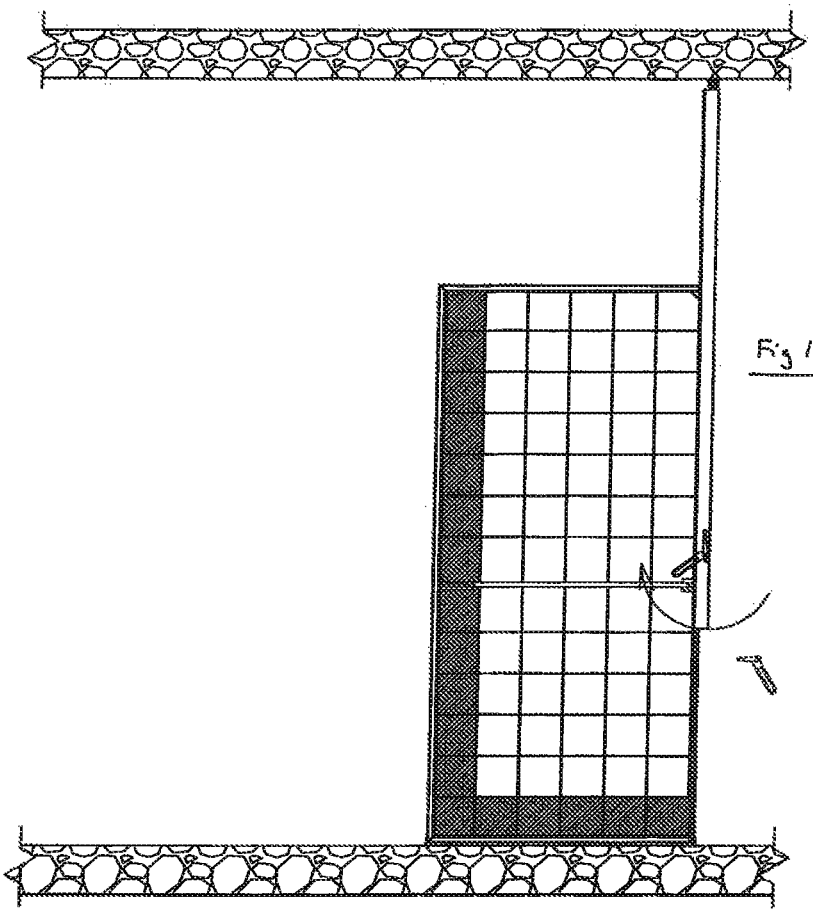
FIG. 10 is a view similar to FIG. 9 wherein the locking tool has been rotated to begin the process of unlocking the locking mechanism of the support post.
Figure 10A:
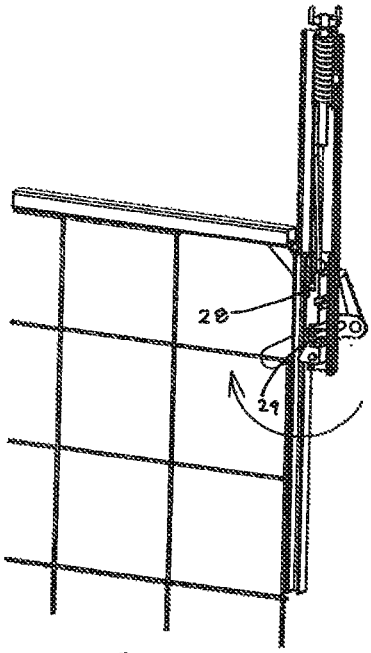
FIG. 10*a* is an enlarged detail longitudinal sectional view of the support post shown in FIG. 10.
Figure 10B:
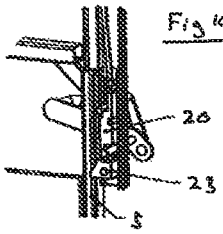
FIG. 10*b* is an enlarged detail view of the locking mechanism shown in FIG. 10*a*.

Dismantling or retracting the support post requires tool 26 to be re-positioned such that shaft 28 is received above lock body 20 (see FIGS. 9*a* and 9*b*) with lower shaft 29 received between the lock body and latch 23. Rotation of tool 26 causes upper shaft 28 to be drawn in a downward and (in this embodiment) outward direction until such time as lock receiver 22 is received about lock retainer 21 and the lock is once again returned to its locked position with spring 10 in a compressed configuration. Movement of tool 26 in this manner also assists in rotating latch 23 such that it no longer engages second elongate member 5. The retraction of spring 10 to its compressed configuration helps to relieve the pressure upon latch 23. At the point that the lock is in its locked position the first and second elongate members will be free to telescopically slide along one another permitting first elongate member 4 to be moved in a downward direction for purposes of dis-assembly and/or transportation. It will be understood that other ways of locking and unlocking support post 1 could be utilized aside through the use of tool 26.

Figure 11:
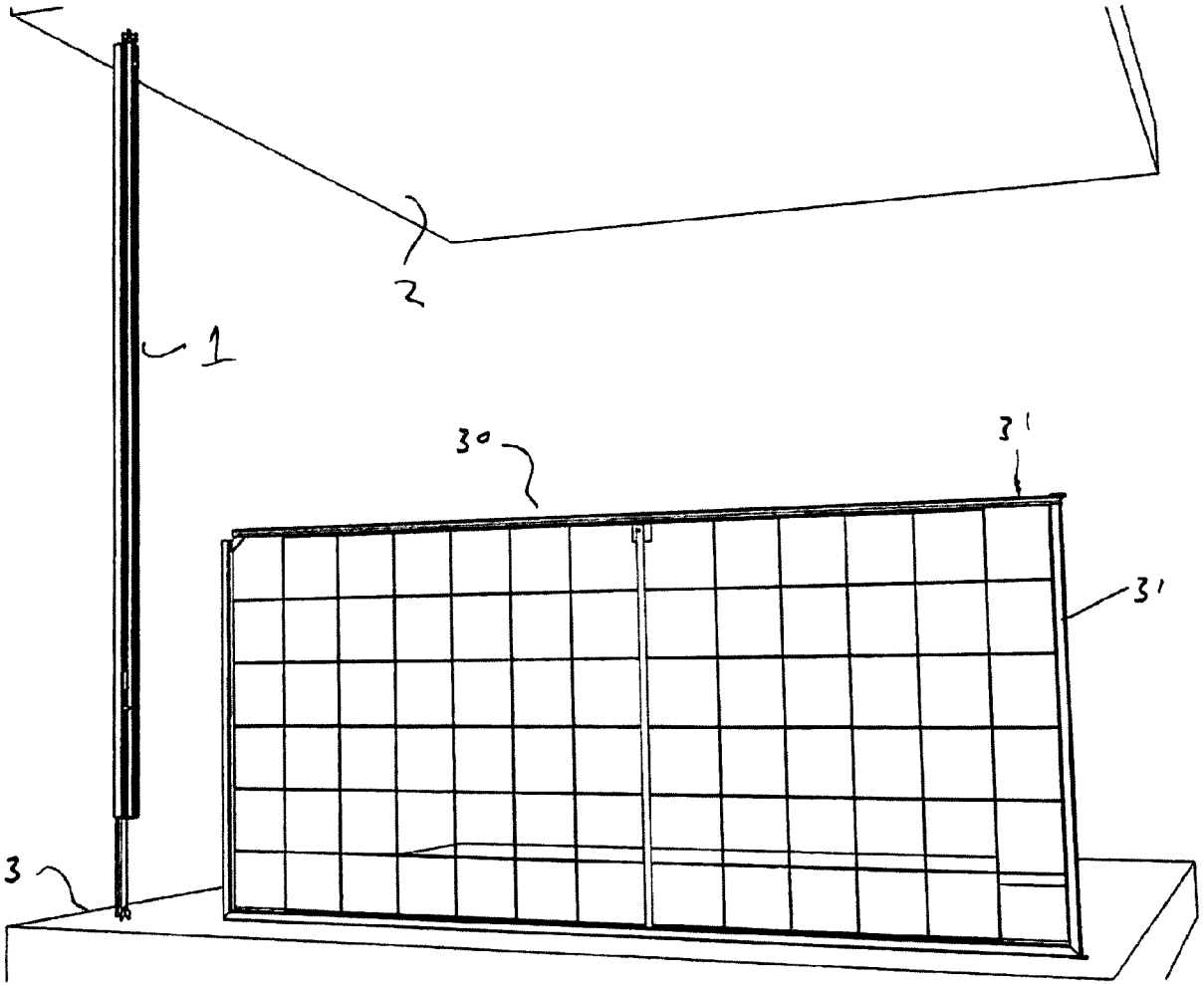
FIG. 11 is a representative view showing a support post in accordance with an embodiment of the invention extending between a floor and ceiling structure with a representative safety barrier in a horizontal configuration.

Support post 1 may be designed and used as a stand-alone post to which a fence panel or safety barrier 30 may be secured by any standard means (wiring, bolting, screwing, clamping, etc.) in order to form part of a barrier system (see FIG. 11). Alternately, support post 1 may be an integral part of fence panel 30 for use solely in a barrier application. In this embodiment (see FIGS. 12 through 19) fence panel 30 includes a rigid rectangular frame 31 (with a top, bottom and two end portions) wherein second elongate member 5 of support post 1 is comprised of one (or at least a portion of one) of the frame members of the fence panel. That is, second elongate member 5 will serve the dual function of comprising one of the telescoping members that comprises support post 1 while at the same time serving as a rigid structural feature of the fence panel. In an alternate embodiment frame 31 may include lateral or longitudinal interior members and the first elongate member of the support post may be telescopically received about at least a portion of the lateral or longitudinal member. Securing support post 1 between a ceiling and a floor structure will thus result in the fence panel also being secured in place. Further, combining a fence panel with an integrated support post could present manufacturing cost advantages, as well as shipping and inventory advantages.

Figure 16:
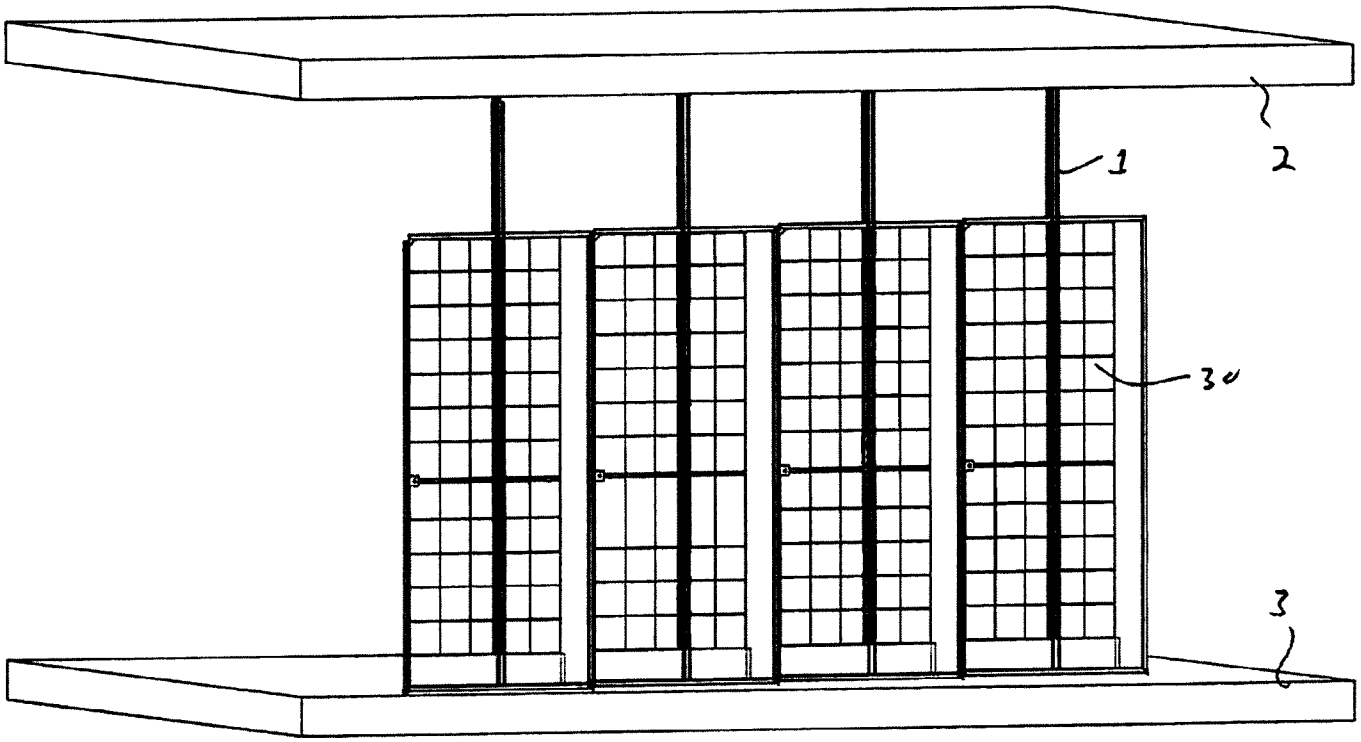
FIG. 16 represents a further orientation of safety barriers and support posts in accordance with an embodiment of the invention.
Figure 17:
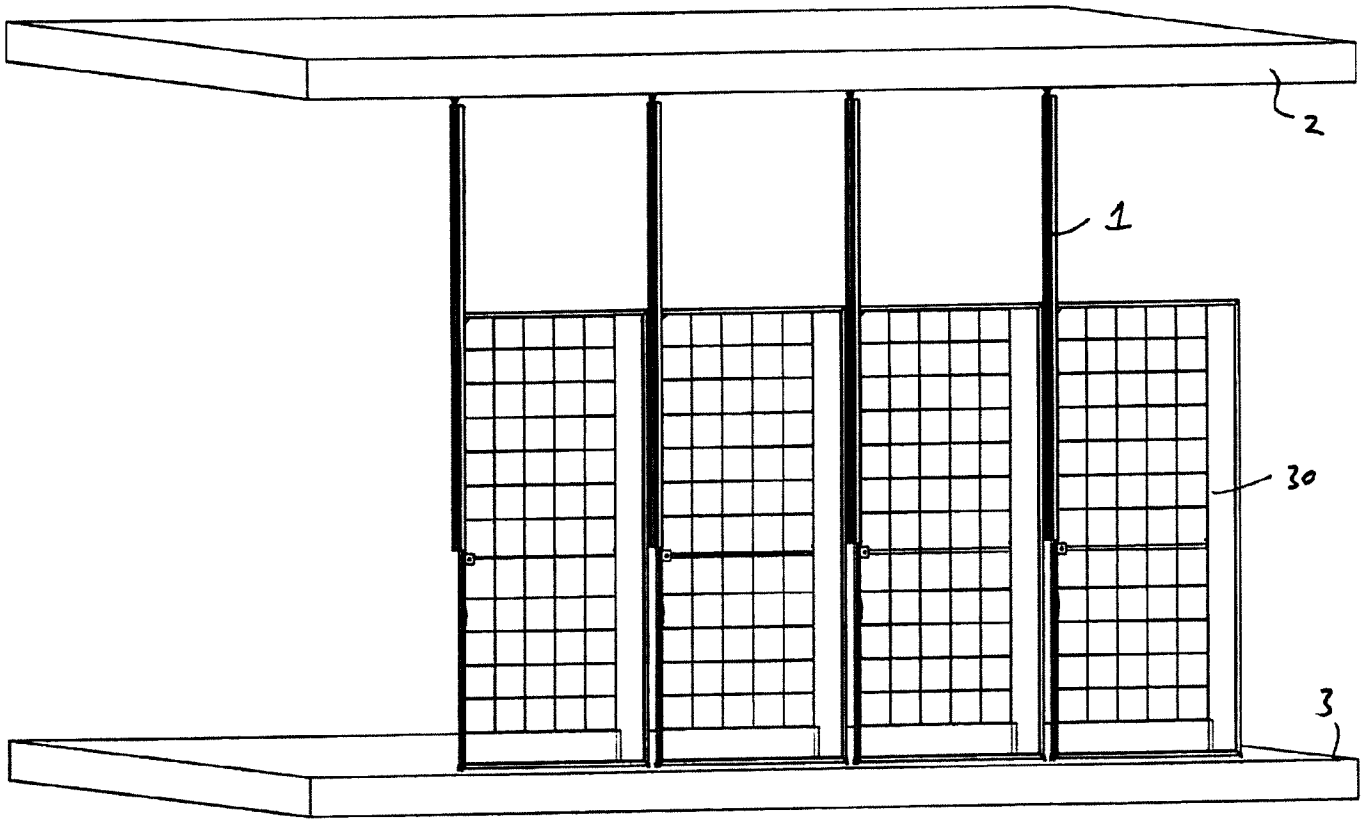
FIG. 17 represents a further orientation of safety barriers and support posts in accordance with an embodiment of the invention.
Figure 18:
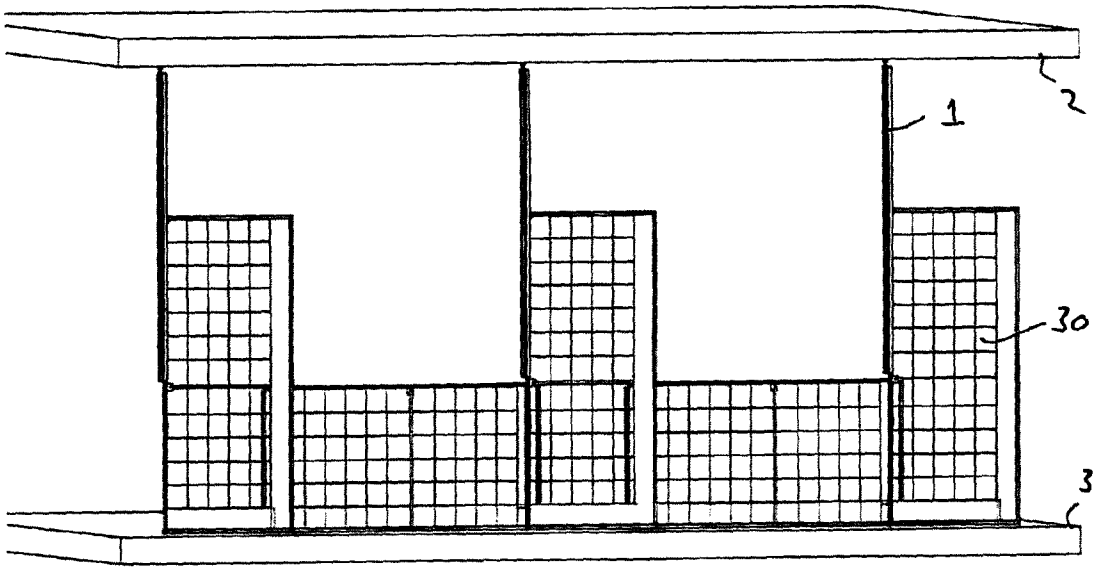
FIG. 18 represents an example of an orientation of safety barriers and support posts wherein the barriers are both longitudinally and horizontally oriented.
Figure 19:
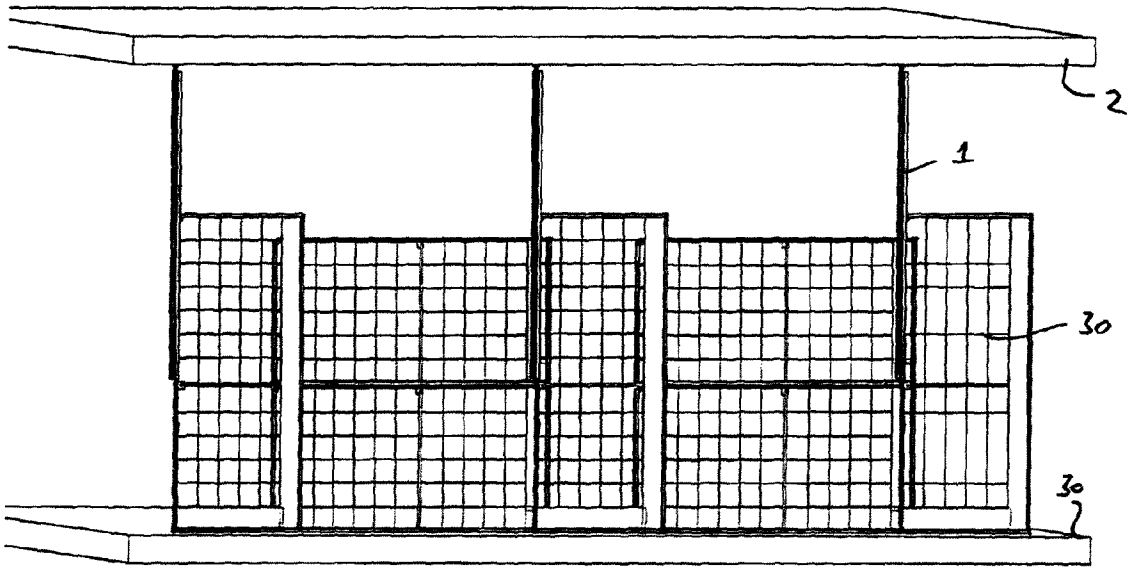
FIG. 19 represents a further orientation of safety barriers and support posts in accordance with an embodiment of the invention.
Figure 20:
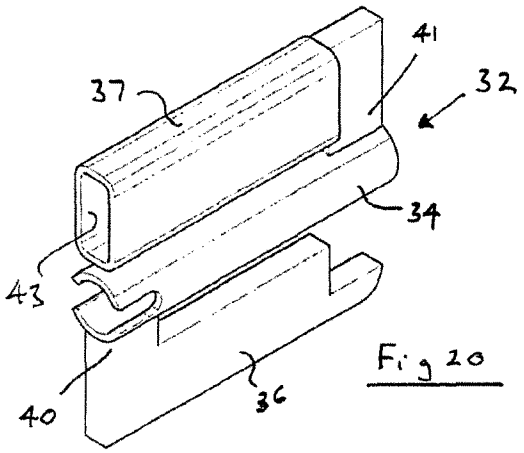
FIG. 20 is an upper side perspective view of an alternate embodiment of the fence lock shown in FIG. 12.
Figure 21:
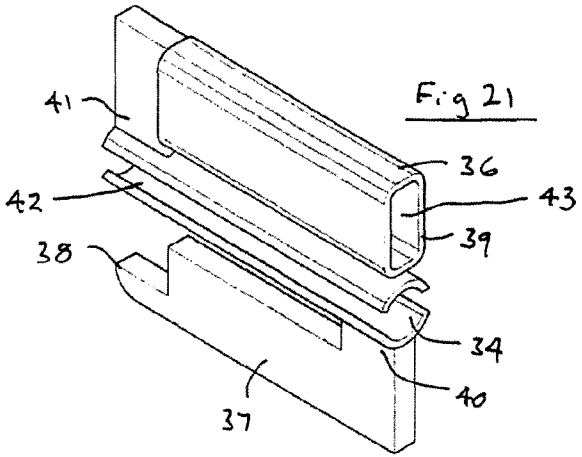
FIG. 21 is an opposite upper side perspective view to that shown in FIG. 20.
Figure 22:
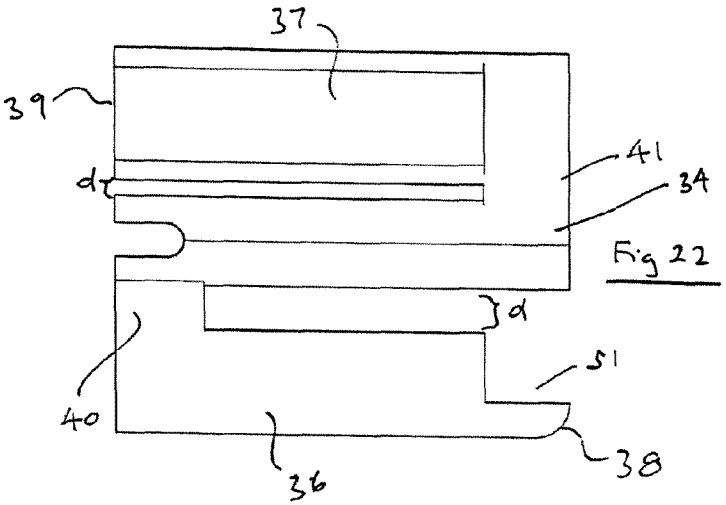
FIG. 22 is a front side elevational view of the fence lock shown in FIG. 20.
Figure 23:
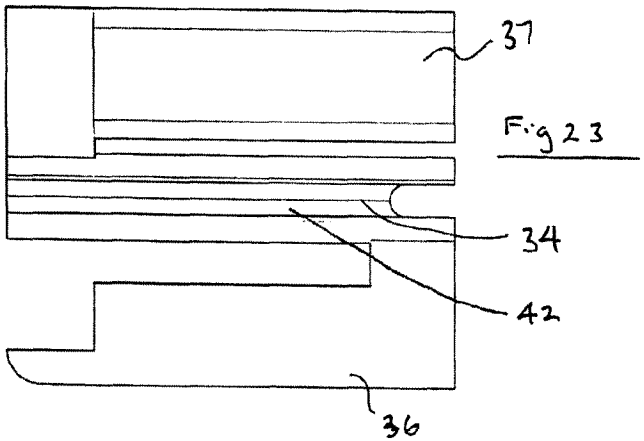
FIG. 23 is a rear side elevational view of the fence lock shown in FIG. 20.

It will be appreciated that positioning a plurality of such support posts and fence panels in combination and adjacent to one another will enable the formation of an extensive safety barrier. It will also be appreciated that in many instances fence panel 30 will be generally rectangular in shape, but that second elongate member 5 may form either the short or the long side of the rectangular frame member. Depending upon which of the frame members comprise second elongate member 5, the rectangular fence panel will be secured in a direction with its longitudinal axis either vertical or horizontal. Further, and as shown in FIG. 16, in an alternate embodiment of the invention second elongate member 5 may take the form of a cross member extending through the mid-portion of fence panel 30 and not specifically one of the fence's exterior frame members.

Although not specifically shown in the attached drawings, one of ordinary skill in the art will appreciate that support post 1 could be fitted with a visual indication device to visually alert an operator as to whether or not spring 10 is in its compressed or released configuration. Doing so will allow the operator to instantly appreciate whether or not support post 1, when engaging both ceiling structure 2 and floor structure 3, is "safe", that the spring has "fired" and that latch 23 is securely holding the two telescoping elongate members in a fixed relationship.

It will also be appreciated that in the embodiment shown in the drawings spring 10 is positioned such that it drives ceiling engaging member 6 upwardly into ceiling structure 2. In an alternate embodiment the entire structure could essentially be turned end-for-end with spring 10 effectively driving floor engaging member 3 into the floor structure. It will thus be understood that throughout the current application when reference is made to a ceiling and a ceiling engaging member the invention should be construed so as to be sufficiently broad so as to equate the ceiling with a floor or other rigid structure. Through the use of an alternate arrangement of rods within the interior of the first elongate member 4 it will also be possible to vary the location of spring 10 within the first elongate member.

In one aspect the invention thus provides a robust support post that may be used as a stand-alone post or in combination with a fence panel as described. The support post includes an efficient locking structure which permits the post to be deployed and secured in place between a ceiling and floor structure or between other rigid structures in either a vertical, horizontal or inclined plane. Since the operative mechanisms of the post are located substantially within the interior of first elongate member 4, there are generally no exterior parts to become broken or damaged during transport, there are no exterior handles that can be broken or upon which other objects may be caught, and the post cannot be altered, unlocked or dismantled without the use of a specialized tool. The latter point can be significantly advantageous as currently available posts typically allow any passersby to remove the post, unlock the locking structure, or otherwise interfere with the proper operation of the posts by simply grasping an exterior handle. In order to avoid such unauthorized use or access many currently available posts require the addition of keyed locks, which adds to both the complexity and the cost of the installation of a barrier system.

Figures 12, 12A, 12B:
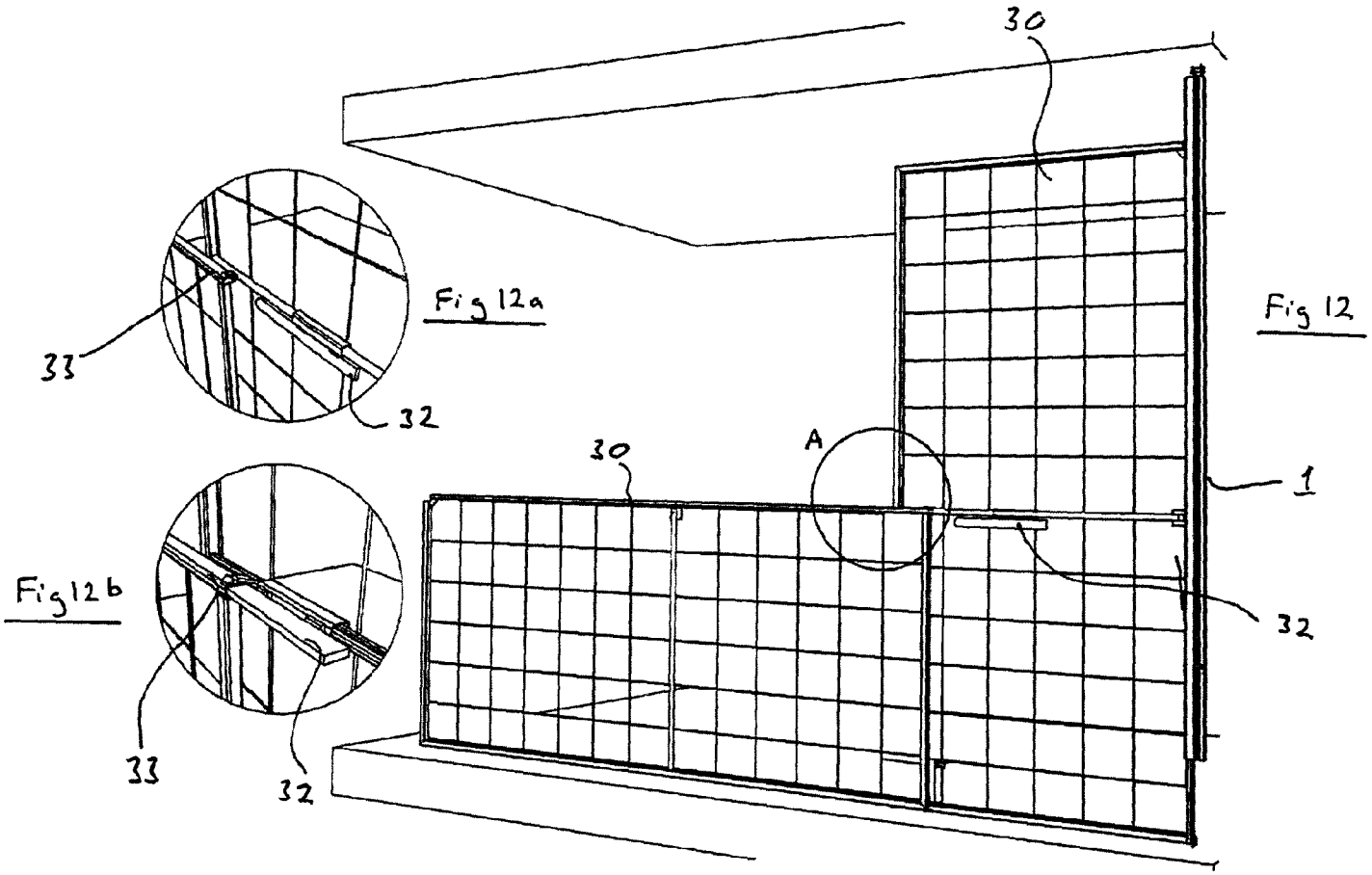
FIG. 12 is a representative view of a safety barrier in a generally vertical configuration having a support post in accordance with an embodiment of the invention attached to its longitudinal frame member and with the safety barrier secured to a second safety barrier through the operation of a fence lock.
FIG. 12*a* is an enlarged detail view of portion "A" of FIG. 12.
FIG. 12*b* is a view similar to FIG. 12*a* wherein the fence lock of the vertical safety barrier has been received within the fence lock receiver of the horizontal safety barrier.
Figure 13:
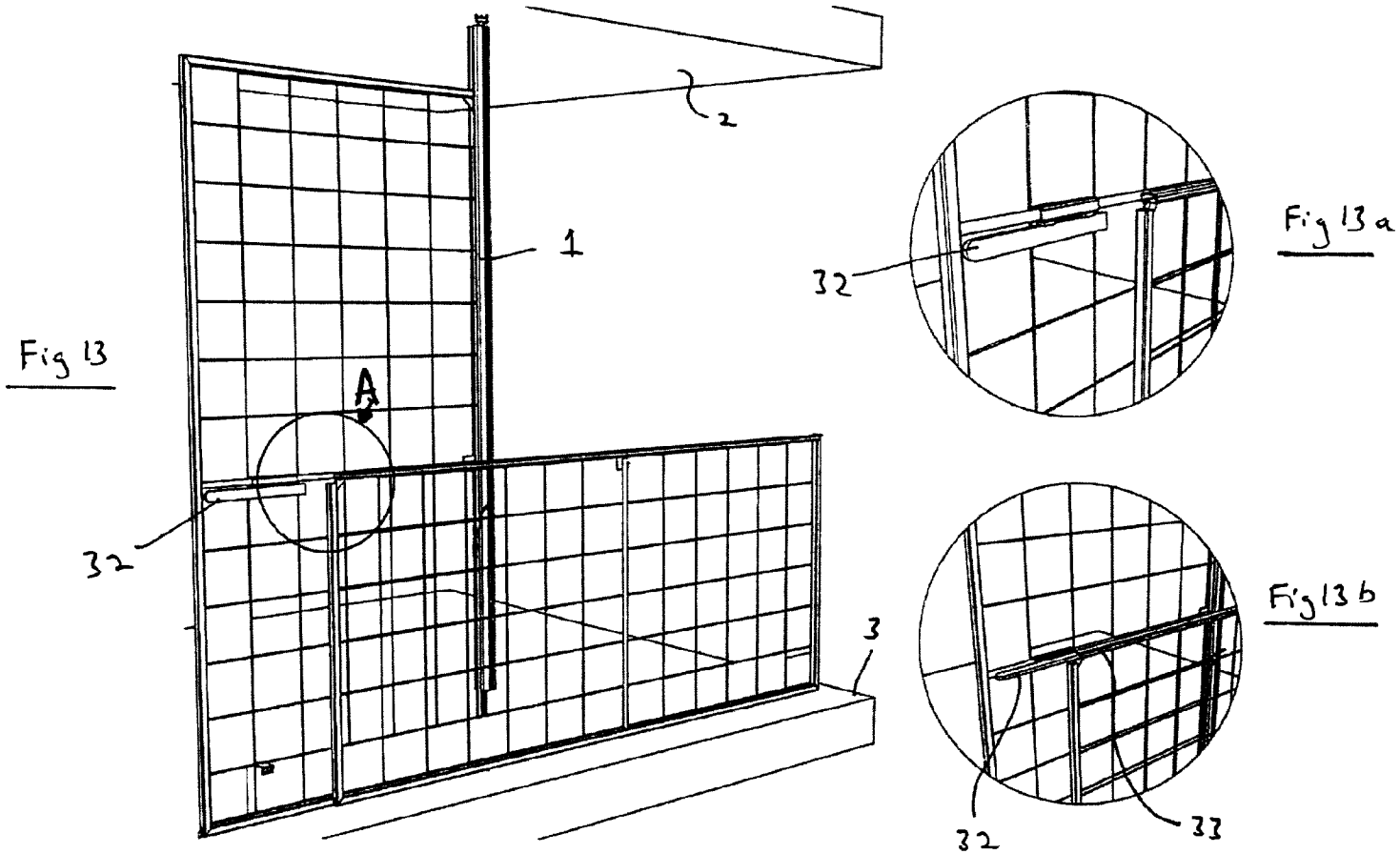
FIG. 13 is a view similar to FIG. 12 wherein the support post is positioned on the opposite longitudinal frame member of the vertically oriented safety barrier.
Figure 14:
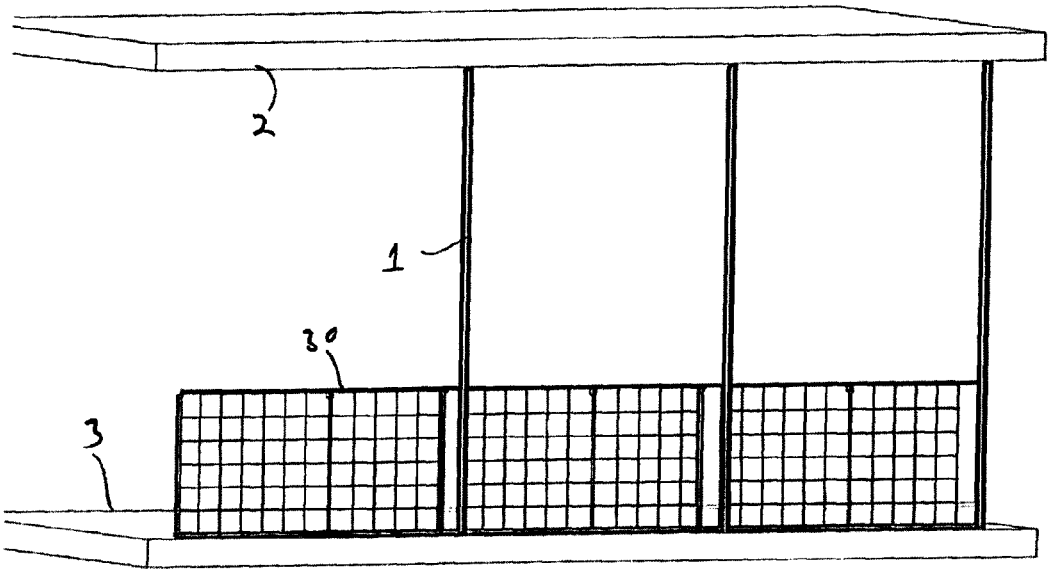
FIG. 14 demonstrates one particular orientation of safety barriers and support posts in accordance with an embodiment of the invention.
Figure 15:
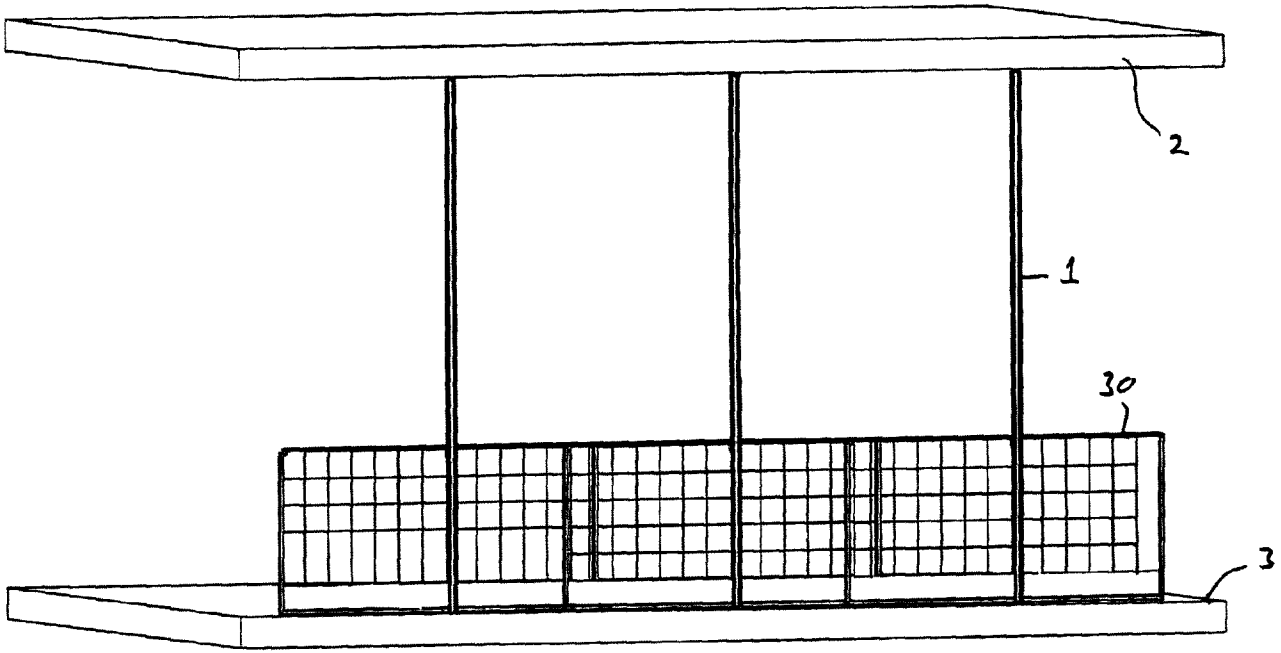
FIG. 15 demonstrates an alternate orientation of safety barriers and support posts in accordance with an embodiment of the invention.

FIGS. 12 through 19 generally show different configurations of safety barriers that can be created through the utilization of support posts 1 and fence panels 30. In some instances it will be advantageous to include means to secure adjacent panels to one another, or to another adjacent structure (such as a wall, pillar, post, column, etc). One such means is depicted in FIGS. 12 and 13. Here, one of the fence panels is fitted with a slidable locking bar or fence lock 32 that is received over a structural member of the fence panel and that engages a fence lock receiver 33 on an adjacent fence panel to hold the two panels together. In the case of FIGS. 12 and 13, the vertically oriented panel is held in place through the operation of support post 1, as described above. The horizontally oriented panel overlaps the vertical panel and is secured thereto through sliding fence lock 32 into lock receiver 33.

In FIGS. 20 through 48 there is shown a fence lock for releasably securing a fence panel to an adjacent fence panel or other structure. The fence lock is noted generally by reference numeral 32 and is an alternate embodiment to the fence lock shown in FIGS. 12 and 13. In the embodiment of FIGS. 20 through 48, fence lock 32 is comprised of a central body 34, slidably received over a structural member 35 of fence panel 30, and at least one arm. In the particular embodiment shown the fence lock includes a first arm 36 and a second arm 37. As is shown most clearly in FIGS. 20 through 23, central body 34 is a generally longitudinal tubular member having a hollow interior with arms 36 and 37 secured to the central body on opposite sides such that the arms generally lie in the same plane. Arms 36 and 37 are oriented with their longitudinal axes generally parallel to the longitudinal axis of the central body. Each of arms 36 and 37 have a free end, 38 and 39 respectively, and a fixed end, 40 and 41 respectively, by which the arms are attached to a central body 34. The arms are set off a distance "d" from central body 34 in order to permit the free end of at least one of arms 36 and 37 to be inserted into a receiver on an adjacent fence panel or other structure.

The hollow interior of central body 34 preferably has a dimension that allows it to be received over and slide along the length of structural member 35 of fence panel 30. In one embodiment of the invention, the central body has an elongate slit or opening 42 along its length in communication with the hollow interior of the central body.

The size or dimension of slit 42 is such that it allows the central body to be releasably received about structural member 35 with the structural member situated within the hollow interior of the central body. The cross-sectional dimension of the hollow interior of central body 34 is also such that the central body is permitted to rotate about structural member 35 so that arms 36 and 37 can be oriented in a desired position. In an alternate embodiment, there is no slit in the central body and the central body is permanently, rotationally, received over structural member 35.

Referring again to FIGS. 20 through 23, as mentioned above, in the embodiment depicted fence lock 32 includes two arms 36 and 37. In this particular version of the fence lock, the free ends, 38 and 39, of the two arms are directed opposite to one another such that the fence lock generally assumes a Z-shape. It will be appreciated that in alternate embodiments a single arm could be utilized (see FIG. 12) or, the two arms could have their free ends pointing in the same direction such that the fence lock takes on an E-shape. In the case of the fence lock shown in FIGS. 20 through 23, second arm 37 is generally tubular having at least a partially hollow interior 43 that permits the arm to receive a locking finger on an adjacent fence panel or other structure. The cross-sectional dimension of interior 43 is such that it is greater than the cross-sectional dimension of arm 36 such that arm 36 on a first fence lock of a first fence panel may be received within the interior 43 of an arm 37 of a second fence lock on a second adjacent fence panel as a means to hold the two fence panels together.

The function and operation of fence lock 32 will now be described in further detail with reference to FIGS. 24 to 48.

Figure 25:
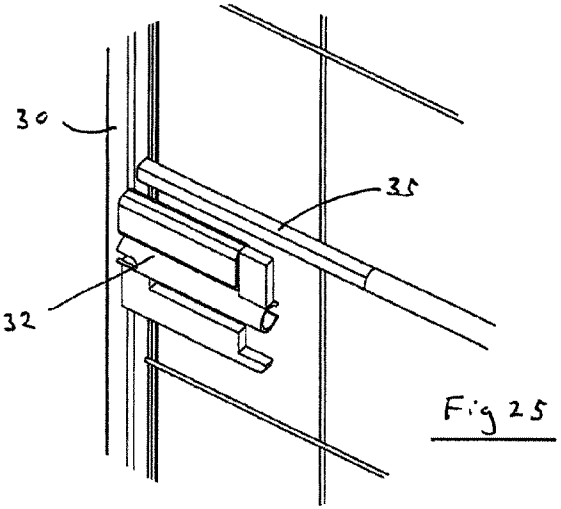
FIG. 25 is an enlarged detail view of a portion "A" FIG. 24.
Figure 26:
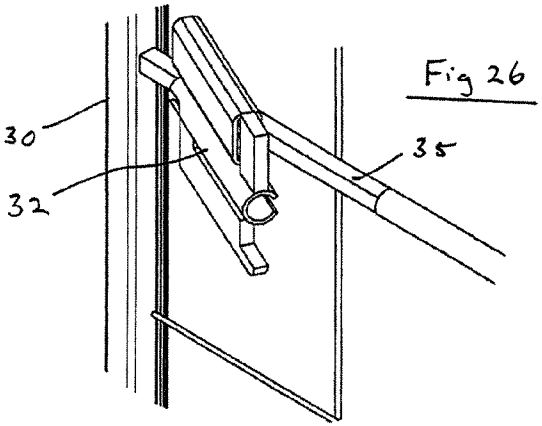
FIG. 26 shows the fence lock of FIG. 20 as it is initially being attached to the safety barrier.
Figure 24:
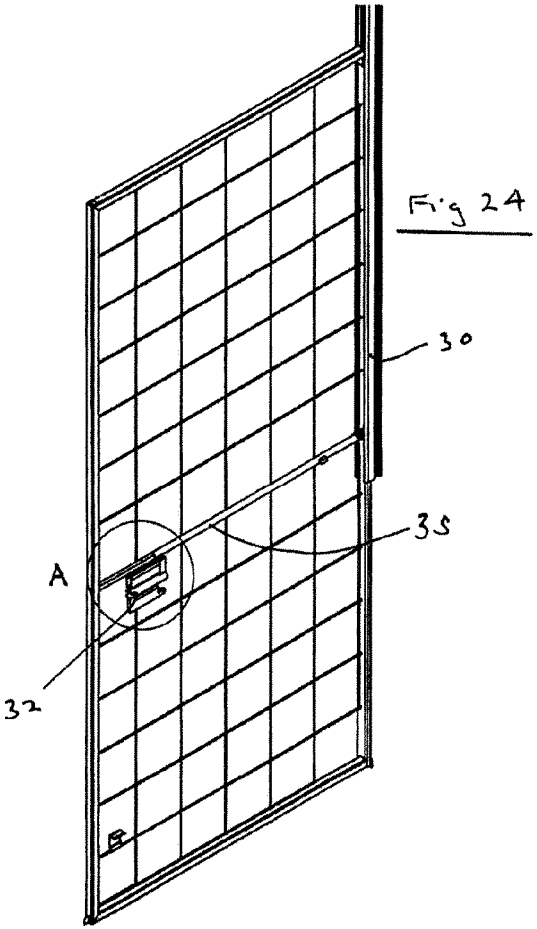
FIG. 24 is a side perspective view of a safety barrier showing the application of the fence lock FIG. 20.
Figure 28:
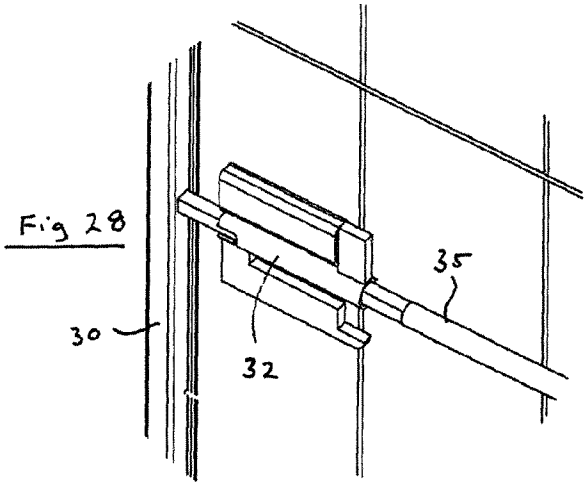
FIG. 28 is an enlarged view of portion "A" of FIG. 27.
Figure 29:
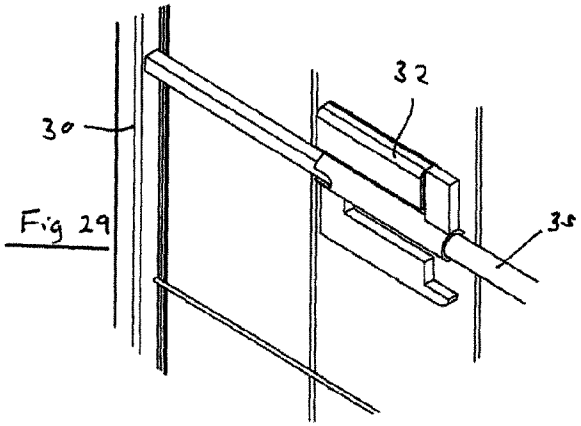
FIG. 29 is a view subsequent to FIG. 28 wherein the fence lock has been slid laterally along the structural member of the safety barrier.
Figure 27:
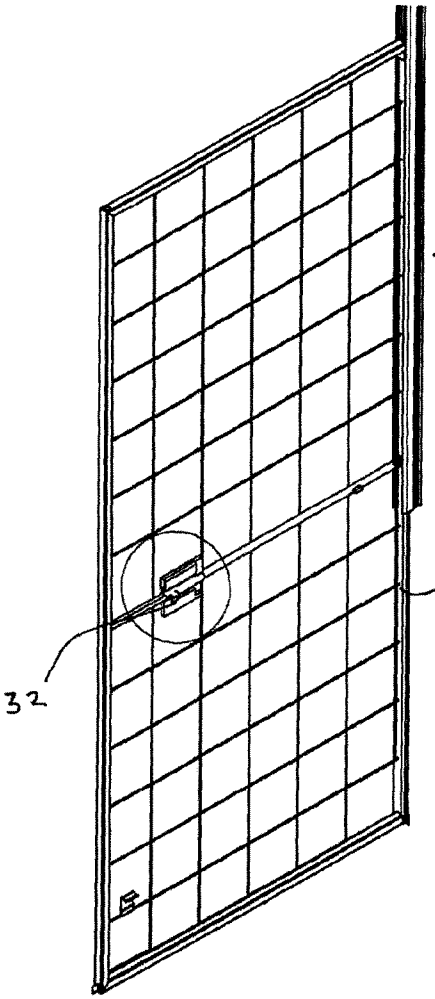
FIG. 27 is a view similar to FIG. 24 wherein the fence lock has been received about a structural member of the safety barrier.
Figure 31:
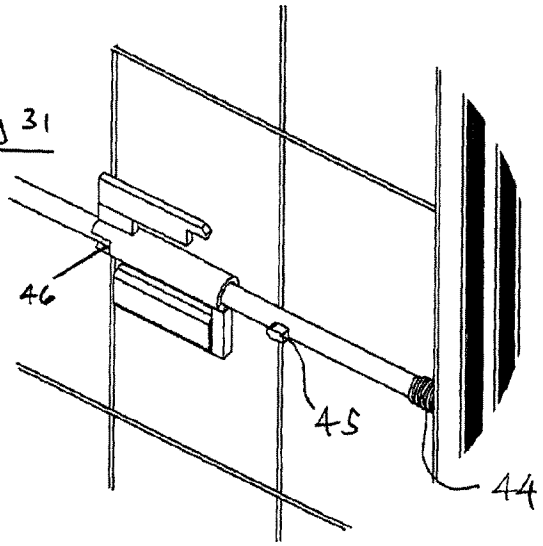
FIG. 31 is an enlarged detail section of portion "A" of FIG. 30.
Figure 32:
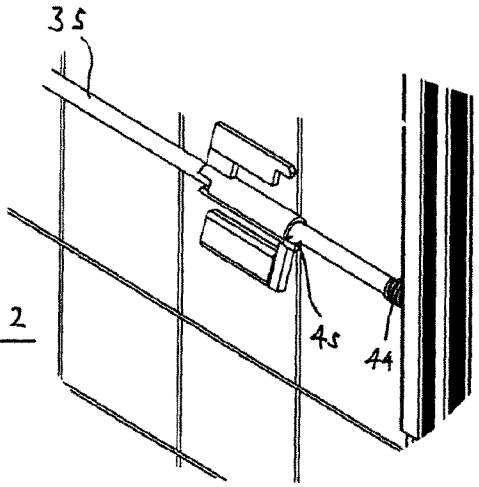
FIG. 32 is a view subsequent to FIG. 31 where the fence lock has been rotated about the structural member to allow it to bypass a stop on the structural member.
Figure 30:
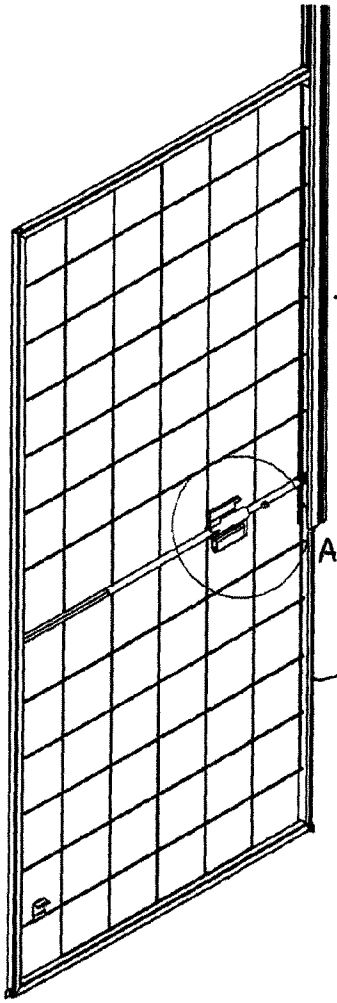
FIG. 30 is a view similar to FIG. 27 wherein the fence lock has been slid toward the opposite end of the structural member of the safety barrier.
Figure 34:
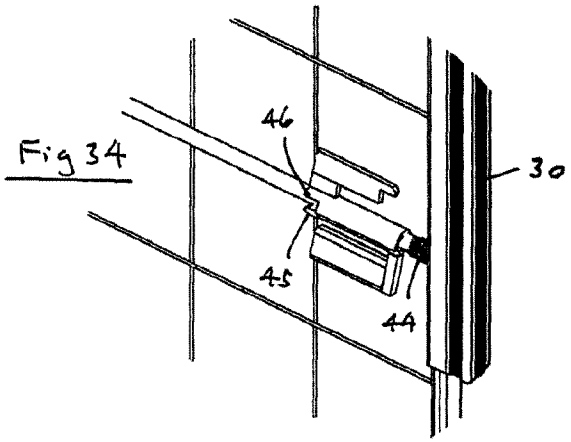
FIG. 34 is a view subsequent to FIG. 33 wherein the fence lock is being slid out to the end of the structural member.
Figure 35:
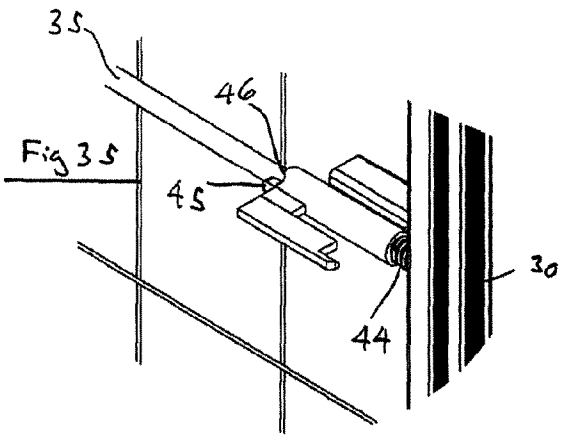
FIG. 35 is a view subsequent to FIG. 34 wherein the fence lock has been rotated about the structural member by approximately 90 degrees.
Figure 33:
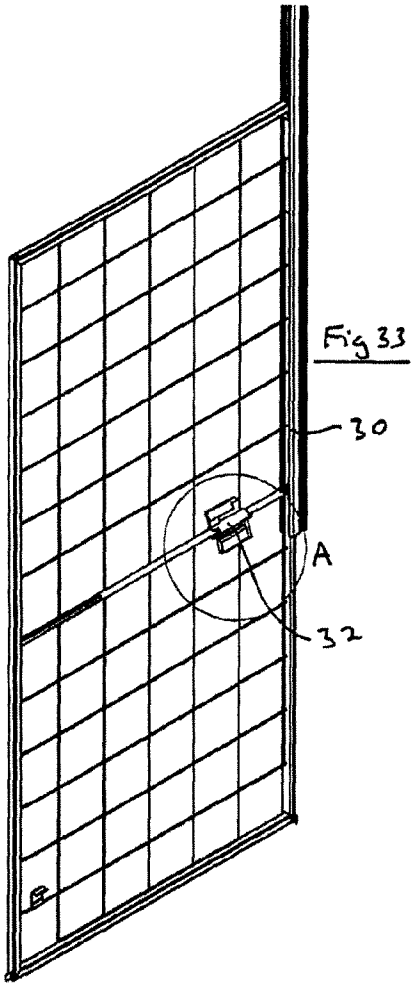
FIG. 33 is view similar to FIG. 31 wherein the fence lock is being slid past the stop on the structural member.
Figure 37:
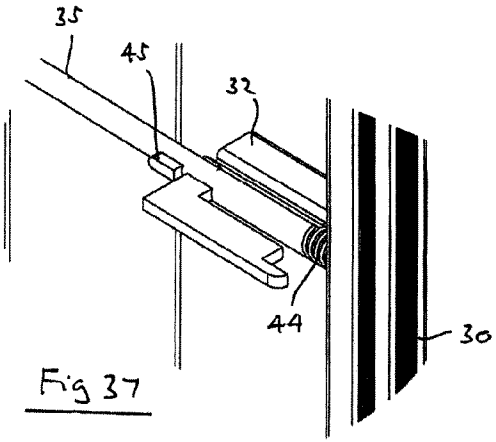
FIG. 37 is an enlarged detail view of portion "A" of FIG. 36.
Figure 38:
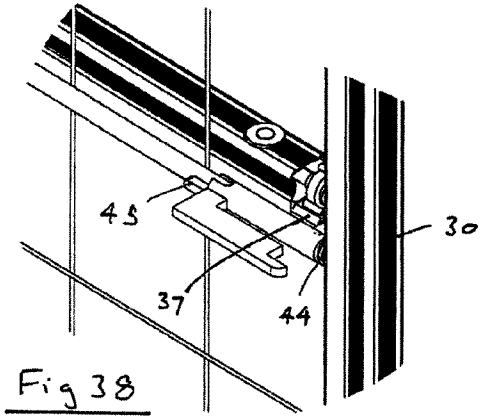
FIG. 38 is a view subsequent to FIG. 37 wherein the support post of an adjacent safety barrier has been received about a portion of the fence lock.
Figure 36:
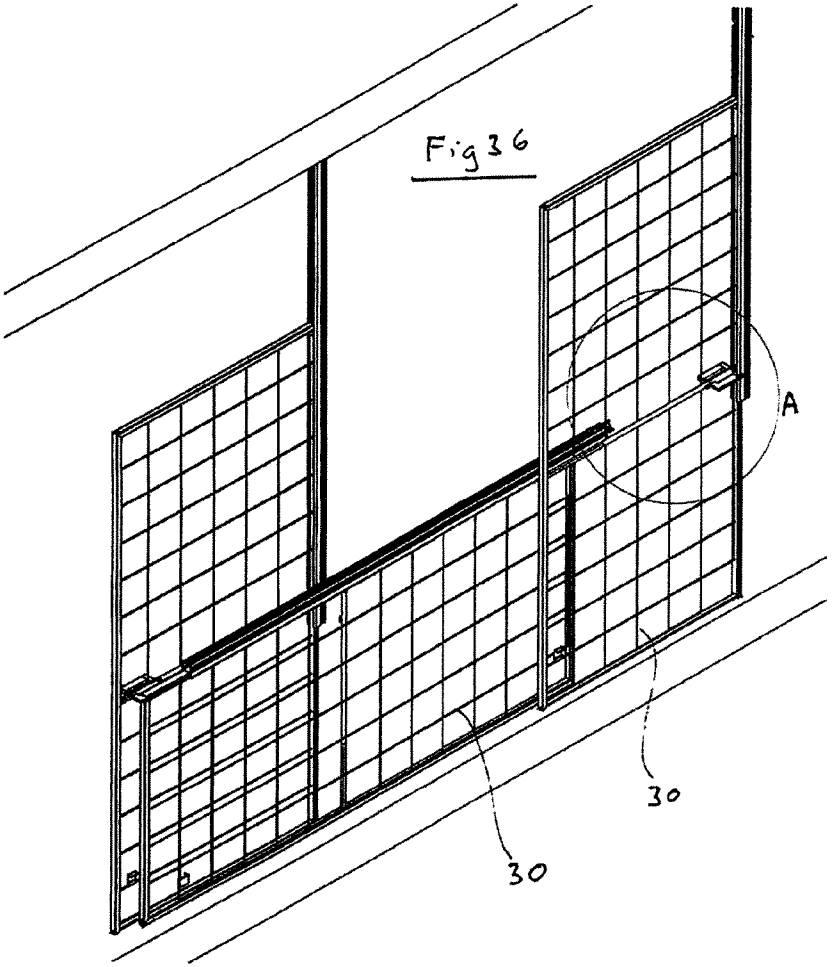
FIG. 36 is a view similar to FIG. 18 including the fence lock of FIG. 20 and wherein the fence lock is positioned to secure the safety barrier to an adjacent safety barrier.
Figure 40:
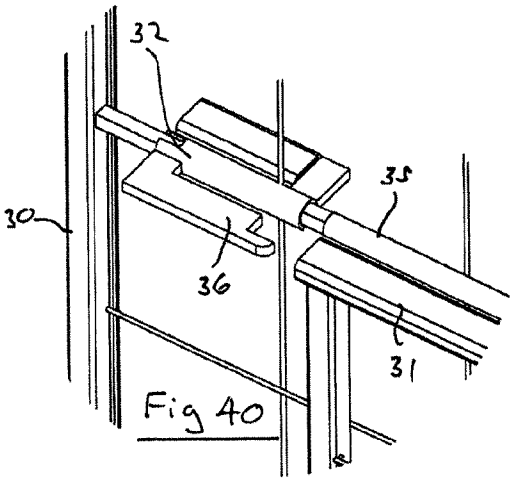
FIG. 40 is an enlarged detail view of portion "A" of FIG. 39.
Figure 41:
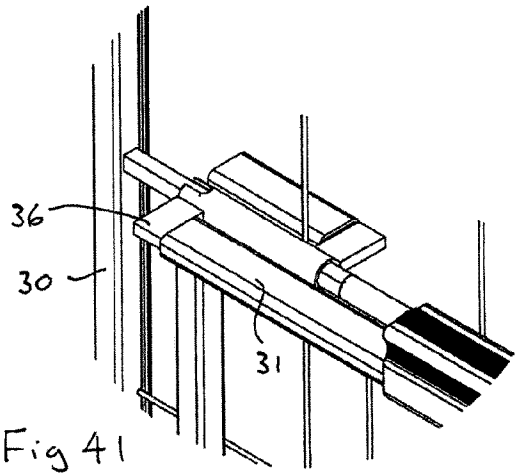
FIG. 41 is a view subsequent to that shown in FIG. 40 wherein a portion of the adjacent safety barrier has been received about a portion of the fence lock.
Figure 39:
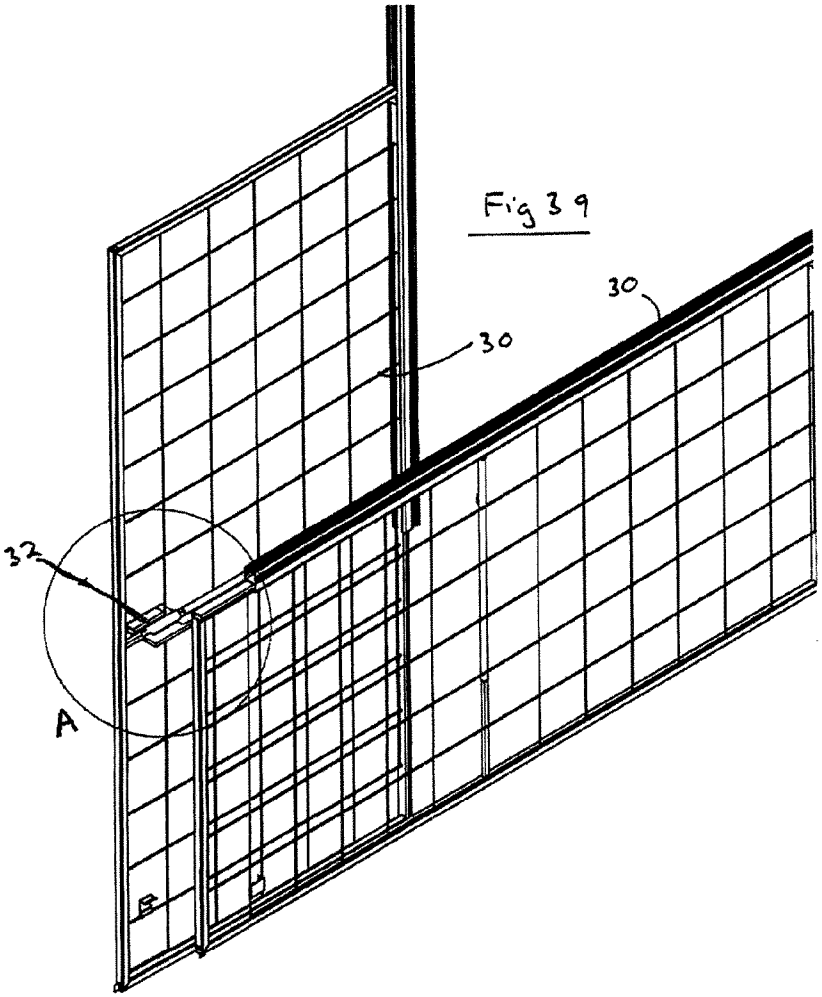
FIG. 39 shows the fence lock at the opposite end of the structural member to that shown in FIG. 38, about to receive the support post of an adjacent safety barrier.
Figure 43:
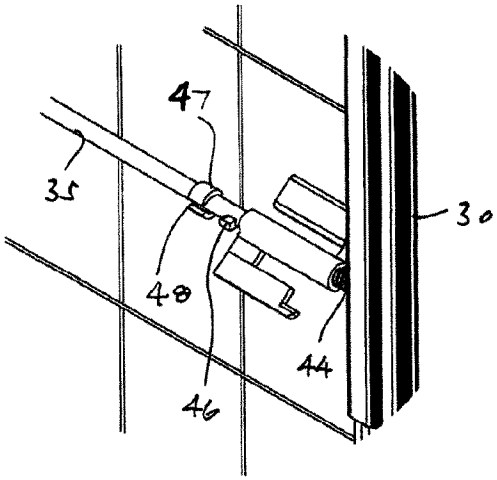
FIG. 43 is an enlarged detail view of portion "A" of FIG. 42.
Figure 42:
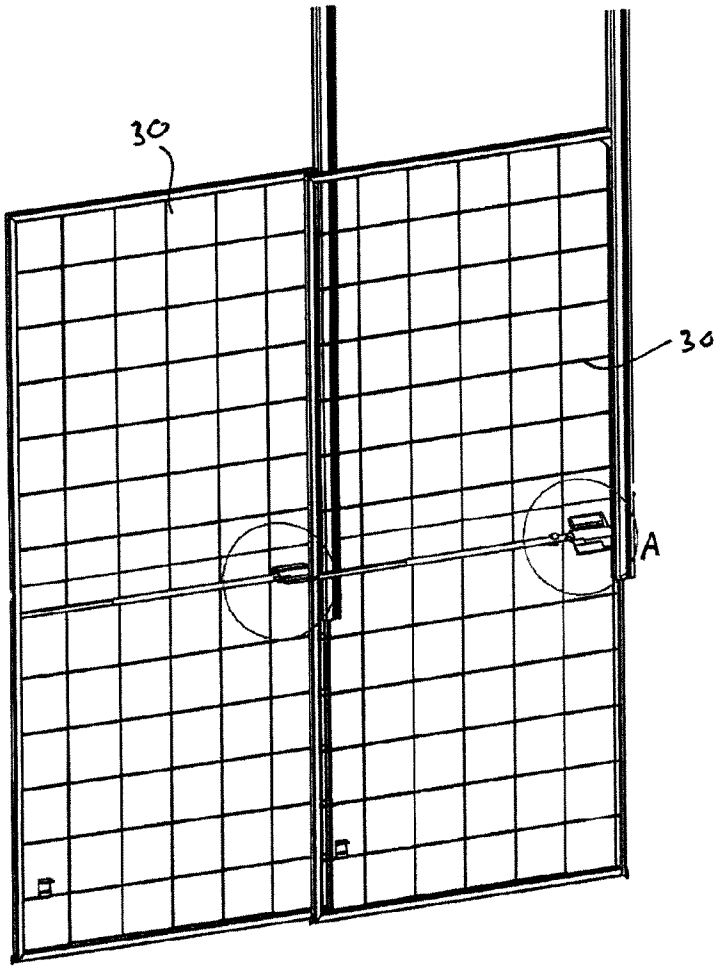
FIG. 42 shows an alternate embodiment of the fence lock that includes the use of a spacer against which the fence lock bears.
Figure 44:
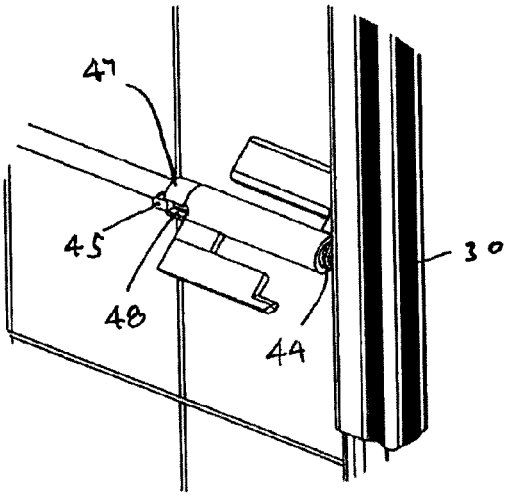
FIG. 44 is a view similar to FIG. 43 wherein the spacer has been received about the stop on the structural member.
Figure 45:
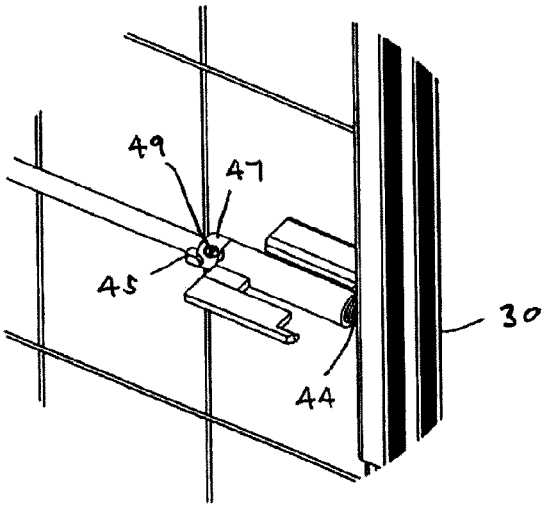
FIG. 45 is a view subsequent to that shown in FIG. 44 wherein the spacer has been rotated and bears against the stop.

In FIGS. 24, 25 and 26, fence lock 32 is shown first approaching the structural member 35, and then as it would be received over the structural member through aligning slit 42 in central body 34 with the structural member to permit the central body to be received over the structural member. Thereafter, with the fence lock received over the structural member, the lock maybe slid along the length of the structural member as desired (see FIGS. 27 through 29). In most instances it is expected that elongate slit 42 will be positioned along the side of central body 34.

It may be desirable to form structural number 35 with a portion of its length having a reduced diameter that facilitates receiving elongate slit 42. With the central body received over the structural member the fence lock may be slid along the length of the structural member to a portion where the structure member has a larger exterior dimension such that it will not fit through elongate slit 42. It will also be noted from the attached drawings that with arms 36 and 37 on opposite sides of the central body, and with the fence lock rotated such that the arms are generally in the same plane as the fence panel, fence lock 32 can be slid along the length of structural member 35 without interfering with the individual wires of the fence panel.

With reference to FIGS. 30 through 35, one end of structural member 35 is preferably fitted with a spring 44 and a stop 45. As fence lock 32 is slid toward stop 45, the lock is rotated to the extent necessary in order to align stop 45 with slit 42, thereby allowing the fence lock to pass by the stop. Once the fence lock has slid past the stop the control body is rotated so that the stop no longer aligns with slit 42. At that point spring 44 will bias central body 34 toward stop 45 and the central body will effectively be retained between the spring and the stop. It will be appreciated that the opposite end of spring 44 will in most instances bear against a portion of the frame of the fence. Arms 36 and 37 can then be rotated to orient them into a position such that they may be inserted into a fence lock receiver on an adjacent fence panel, which is demonstrated in FIGS. 36 through 41. Those Figures show a variety of different configurations and applications of fence lock 32 wherein the arms of the fence lock are received within the hollow interior of a telescopic elongate member of a support post secured to the side of a fence panel, or within one of the structural frame members of the fence panel.

FIGS. 42 through 48 illustrate fence lock 32 in use in association with a spacer 47 that is situated between central body 34 and stop 45. The spacer preferably has a longitudinal slit 48 similar to slit 42 that permits the spacer to be both inserted over structural member 35 and also allows the spacer to be slid along the length of the structural member past stop 45. Once slid past stop 45, spacer 47 can be rotated such that the stop is no longer aligned with slit 48. The spring 44 will at that point bear against central body 34, which will in turn be biased against the end of spacer 47. The central body will be permitted to rotate in either direction without slit 42 becoming aligned with stop 45 due to the intervention of spacer 47. To keep spacer 47 from spinning or rotating about structural member 35 and being unintentionally slid back past stop 45, in one embodiment the spacer includes a locking screw 49 that may be turned through use of an Allen wrench 50 to effectively lock the spacer to the structural member.

Figure 48:
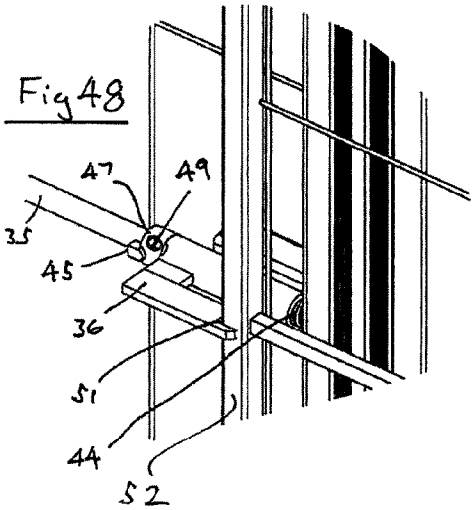
FIG. 48 is an enlarged detail view of portion "A" of FIG. 47.
Figure 46:
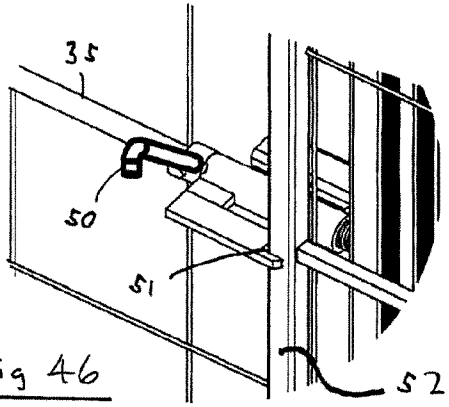
FIG. 46 demonstrates the securement of the spacer in place through the use of an Allen key.
Figure 47:
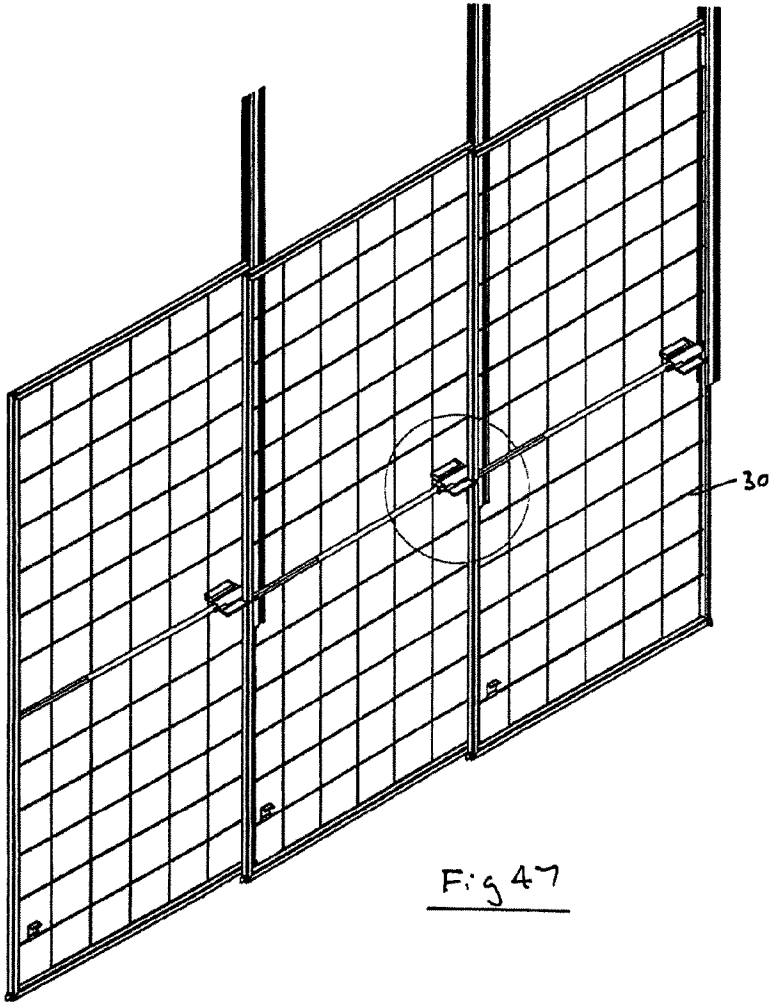
FIG. 47 shows three safety barriers oriented vertically, each having the fence lock of FIG. 20 mounted on a structural member thereof and further having a spacer in place between the fence lock and the stop on the structural member.
Figure 49:
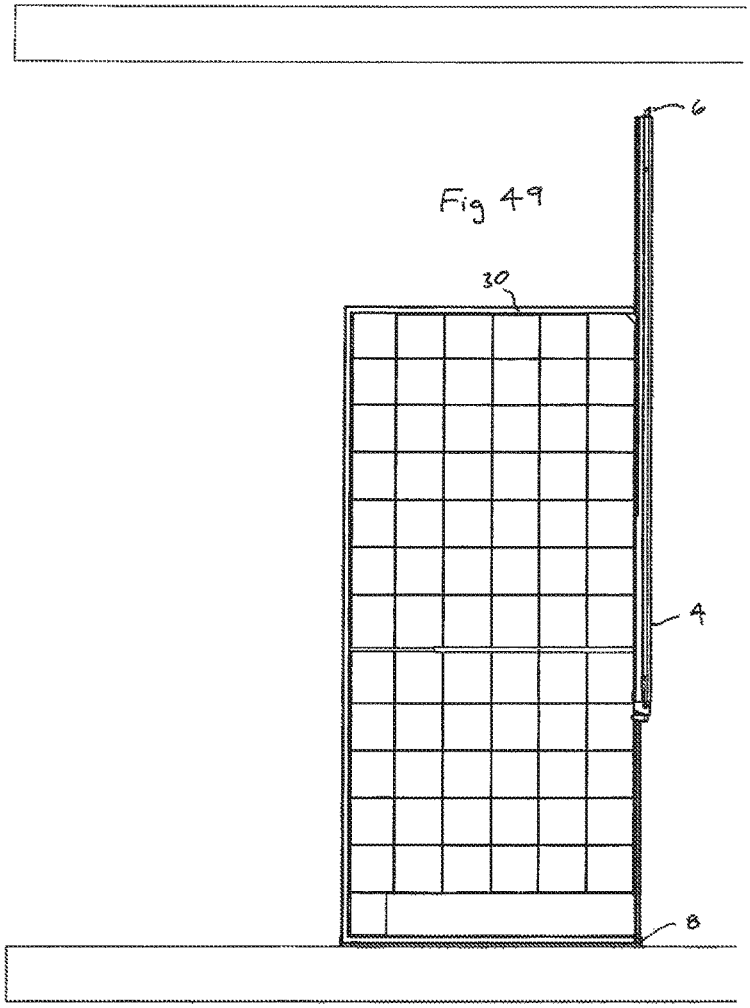
FIG. 49 is a side view of an alternate embodiment of the support post shown in FIG. 10, the support post being secured to a safety barrier.

As is demonstrated most particularly in FIGS. 46 through 48, free end 38 of first arm 36 may include a notch 51 that is received about the exterior surface of a frame member 52 of an adjacent fence panel to effectively secure two fence panels together.

The end of central body 34 adjacent to stop 45 may include a stop engagement or notch 46 intended to effectively "lock" fence lock 32 in a position wherein its arms are generally in the same plane as the fence panel. It can be advantageous to secure fence lock 32 in a position where its arms are generally in the same plane as the fence panel for transportation purposes. That is, with the arms generally co-planer with the fence panel, the fence panel can be transported more easily and without the likelihood of the arms becoming entangled with other fence panels or other objects. Moving the fence lock from its storage or transportation position (where the arms are generally in the same plane as the fence panel) to its active position (where the arms are generally perpendicular to the fence panel) merely requires grasping the fence lock and applying a sufficient rotational force to overcome the biasing force applied by spring 44 to enable the central body to be rotated until notch 46 is clear of stop 45.

It will thus be appreciated that fence lock 32 provides a novel and efficient mechanism through which a fence panel can be secured to an adjacent fence panel or other structure. The lock can be permanently mounted upon the fence panel such that the panel and lock are transported and used together in combination or, alternatively, the lock can be secured to a fence panel as the application at hand requires.

The unique arm structure of the fence lock permits it to secure fence panels together in a variety of different configurations and to fulfill the needs of many different particular applications. The ability of the arms of the fence lock to receive and secure the exterior of a frame member of an adjacent fence panel, the interior of a hollow tubular member of the frame of an adjacent fence panel, the arm of a second fence lock on an adjacent fence panel and the elongate telescopic tubular member of a support post mounted on an adjacent fence panel provides fence lock 32 with significant flexibility in terms of the manner in which it can be used.

Figure 50:
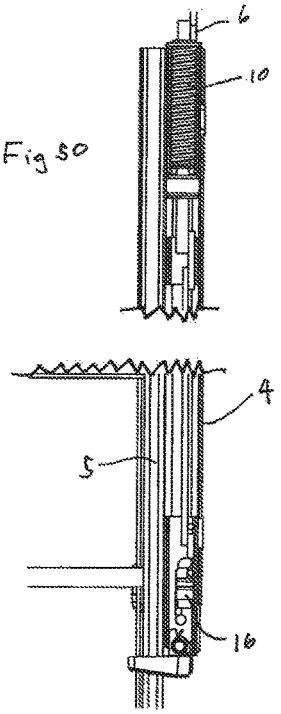
FIG. 50 is an enlarged side sectional view of the support post shown in FIG. 49, the post shown having indefinite length.
Figure 55A:
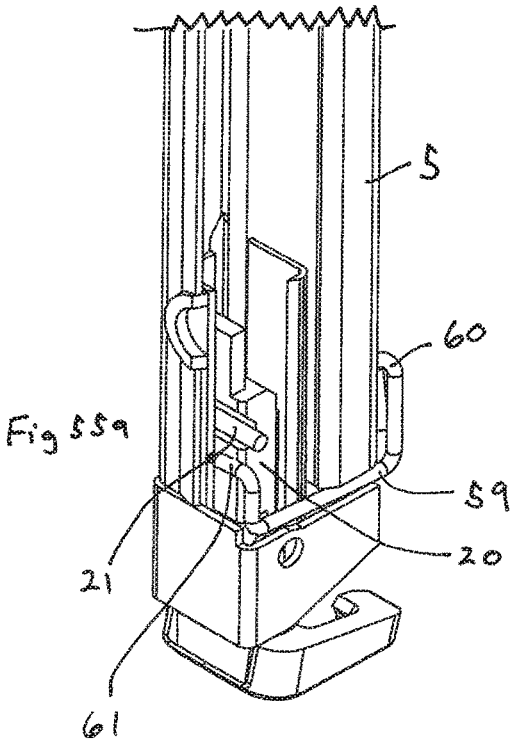
FIG. 55*a* is a rear perspective longitudinal sectional view of the bottom portion of the support post shown in FIG. 50 in its locked position.
Figure 55B:
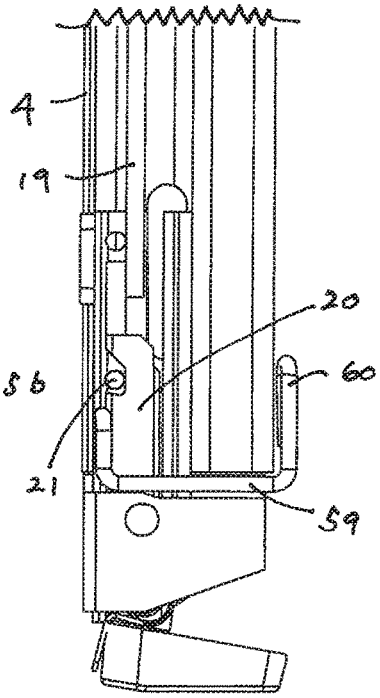
FIG. 55*b* is a side sectional view of the bottom portion of the support post shown in FIG. 55*a*.
Figure 55C:
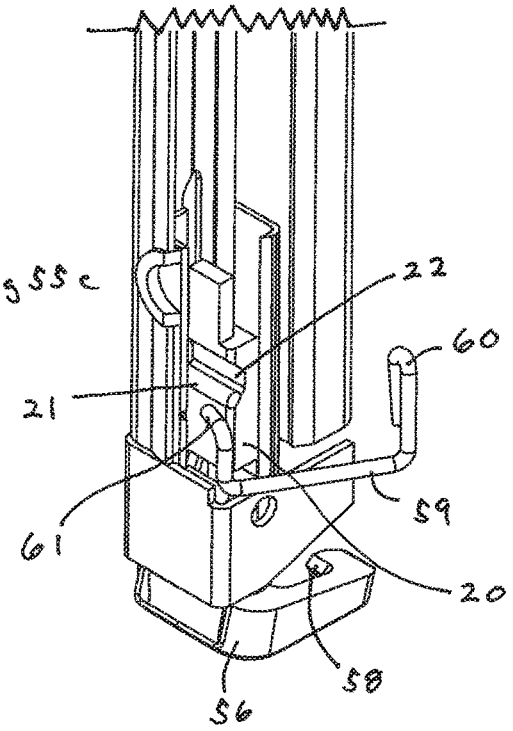
FIG. 55*c* is a view similar to FIG. 55*a* wherein the trigger mechanism has been activated and the support post is in its unlocked position.
Figure 55D:
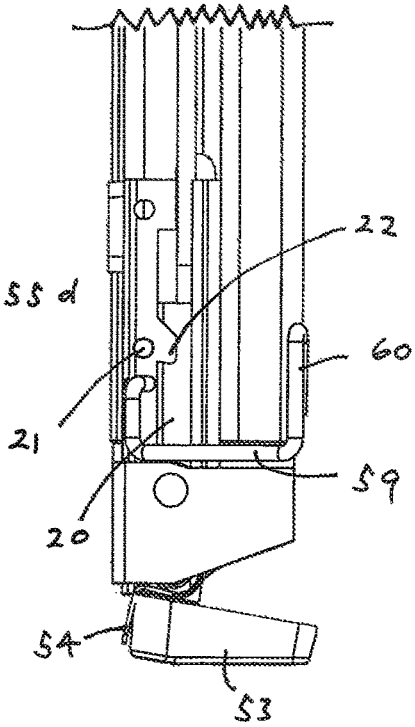
FIG. 55*d* is a view similar to FIG. 55*b* wherein the trigger mechanism has been activated and the post is in its unlocked position.
Figure 56A:
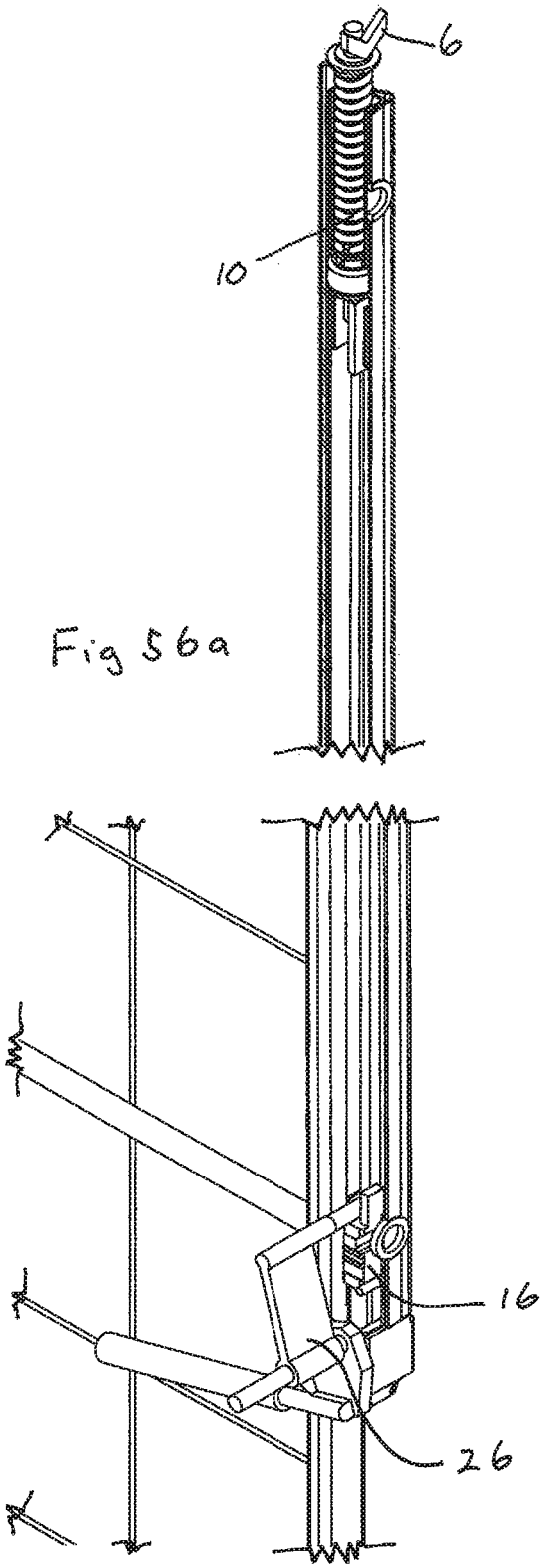
FIG. 56*a* is a rear perspective longitudinal sectional view of the support post shown in FIG. 50 in its unlocked position and having a locking tool inserted therein.
Figure 56B:
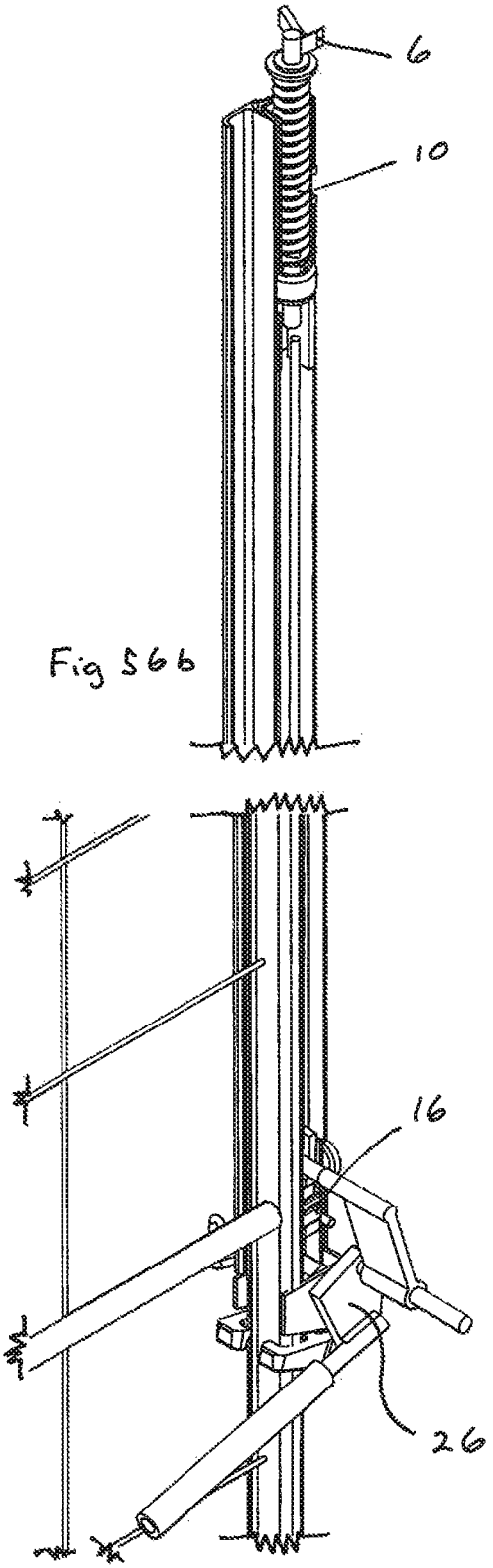
FIG. 56*b* is a view similar to FIG. 56*a* but from a front perspective direction.

FIGS. 49 through 56 illustrate a further embodiment of the support post shown in FIGS. 1 through 10. While the overall function of the support post in FIGS. 49 through 56 and that shown in FIG. 1 through 10 is generally the same, some modifications have been made in the embodiment shown in the latter Figures. In the embodiment of FIG. 50, latch 23 includes a ring member 53, as opposed to the knife edge 25 of the latch of the previously described embodiment. With particular reference to FIGS. 52*a*, 52*b*, 53 and 54, ring member 53 is pivotally mounted to the first elongate member through latch pin 24 and will preferably have an interior opening that is generally rectangular in shape and slightly larger than the exterior cross sectional dimension of the second elongate member. At least a portion of ring member 53 is exterior to first elongate member 4 such that the ring member is slidably receivable about at least a portion of the exterior of second elongate member 5. When the ring member is received about the second elongate member the two elongate members will be telescopically secured to one another. In this embodiment latch 23 further includes a latch spring 54 that bears against both ring member 53 and first elongate member 4 to bias the ring member in a manner that causes it to engage the exterior surface of the second elongate member. As is shown in the attached drawings, latch spring 54 causes the outer end or side 55 of the ring member to be tipped upwardly, relative to latch pin 24. As the outer end 55 of ring member 53 tips upwardly, its inner or opposite end or side 56 (which is generally adjacent to latch pin 24) will be tipped such that its lower edge 57 will engage the exterior surface of second elongate member 5. It will be appreciated that the weight of the first elongate member 4 will have a tendency to push latch pin 24 in a downward direction, effectively causing lower edge 57 to grasp or engage the exterior surface of the second elongate member.

It will also be appreciated that the greater the downward force applied to the inner end or side of the ring member, the more robust the engagement between the ring member and the exterior surface of the second elongate member. In that regard, the functionality of latch 23 is generally equivalent to the embodiment shown in FIGS. 1 through 10. In particular, it will be understood that when lock 16 is in its unlocked position, with spring 10 biasing ceiling engaging member 6 into contact with a ceiling structure, there will be an enhanced tendency to drive the first elongate member (and latch pin 24) in a downward direction relative to second elongate member 5. The effect of this is an enhancement of the engagement or the gripping force between the ring member and the second elongate member, over and above what would be achieved through merely the weight of first elongate member bearing in a downward direction.

Employment of the support post shown in FIGS. 49 through 56 will initially require the extension of first elongate member 4 telescopically along second elongate member 5 in order to initially engage ceiling engaging member 6 with a ceiling structure, while floor engaging member 4 is in contact with the floor structure. This initial "setting" of the post merely requires the application of a manual force (for example through use of the fingers or thumb of a user) to the outer end or outer portion of the ring member in order to overcome the biasing force of latch spring 54 and to position ring member 53 approximately perpendicular to the second elongate member. With the ring member in such a position it can freely slide about the exterior surface of the second elongate member, allowing the two members to be telescopically extended until ceiling engaging member 6 contacts a ceiling structure. At that point releasing the outer end 55 of the ring member causes the latch spring to rotate end 55 upwardly, with lower edge 57 of the inner end 56 engaging the outer surface of the second elongate member and preventing a downward movement of the first elongate member. Thereafter, moving the lock from its locked to its unlocked position will force spring 10 to "drive" ceiling engaging member 6 in an upward direction and into the ceiling structure, which will have the effect of applying a downward force to the first elongate member. That force will be transmitted from the first elongate member through latch pin 24, to the inner end 56 of the ring member, causing an enhancement of the engagement of the ring member with the exterior surface of the second elongate member. If desired, teeth, serrations or a knife edge may be incorporated into the lower edge 57 of the ring member to further enhance its ability to engage the exterior surface of the second elongate member. In addition, the interior surface 58 of the outer end 55 of the ring member may include a chamfer to permit the outer end to be tipped upwardly to a greater degree, effectively allowing for an increase in the angle of attack of the lower edge 57 relative to the surface of the second elongate member.

The lock structure of the embodiment shown in FIGS. 49 through 56 is generally the same as the embodiment shown in FIGS. 1 through 10. However, the embodiment of FIGS. 49 through 56 incorporates a manual release or trigger 59 that permits the lock to be moved from its locked to its unlocked position without the necessity of utilizing tool 26. Trigger 59 allows for the operator to manually apply a force to lock receiver 22 that causes the lock receiver and lock retainer 21 to become disengaged, thereby permitting the movement of the lock from its locked to its unlocked position and causing spring 10 to "fire". It will be appreciated that a variety of different structures could be utilized to perform the function of manually release or trigger 59. In the attached drawings (and in particular FIGS. 55*a*-55*d*) the trigger is comprised of a rigid lever 60 that, when the lock is in its locked position, lies in a plane that is relatively close and adjacent to the exterior surface of first elongate member 4. The opposite or inner end 61 of the lever is received within the interior of first elongate member 4 and between the interior surface of the first elongate member and lock body 20. When it is desired to unlock the lock, lever 60 is grasped and rotated away from first elongate member 4, causing inner end 61 to apply a force against lock body 20 that results in the disengagement of the receiver and the lock retainer and the "firing" of spring 10. Re-setting the lock from its unlocked to its locked position, first requires the return of the manual release or trigger 59 to its "locked" configuration (wherein it is adjacent to the exterior surface of the first engagement member) and then the utilization of a tool 26 to re-engage the lock receiver and retainer, in a manner similar to that described above with respect to the embodiment of FIGS. 1 through 10.

It is to be understood that what has been described are the preferred embodiments of the invention. The scope of the claims should not be limited by the preferred embodiments set forth above, but should be given the broadest interpretation consistent with the description as a whole.

I Claim:

1. A support post for releasably securing between a ceiling structure and a floor structure, the support post comprising:

first and second elongate members, said first elongate member generally tubular with at least a partially hollow interior, said second elongate member telescopically engaged with at least a portion of said first elongate member, a ceiling engaging member positioned at the upper end of said first elongate member and a floor engaging member positioned at the lower end of said second elongate member, a spring biasing said ceiling engaging member in a direction away from said upper end of said first elongate member, a lock positioned within the hollow interior of said first elongate member, when in its locked position said lock maintaining said spring in a compressed configuration and when in its unlocked position said lock releasing said spring from its compressed configuration and permitting said spring to apply a biasing force to said ceiling engaging member urging said ceiling engaging member away from said upper end of said first elongate member, a latch operatively secured to said first elongate member, said latch allowing for the telescopic movement of said first elongate member relative to said second elongate member when said lock is in said locked position, said latch engaging said second elongate member when said lock is in said unlocked position and resisting the telescopic movement of said first elongate member relative to said second elongate member.

2. The support post as claimed in claim 1 wherein said spring is a coil spring with one end bearing against a first pin or support member fixed within said first elongate member and the opposite end bearing against said ceiling engaging member.

3. The support post as claimed in claim 1 including a lock retainer, said lock retainer releasably engagable with said lock to releasably secure said lock in its locked position with said spring in its compressed configuration, said lock reverting to said unlocked position when said lock is disengaged from said lock retainer.

4. The support post as claimed in claim 3 wherein said lock includes a receiver, said lock retainer releasably engagable with said receiver, one of said lock retainer and said receiver comprising a pin and the other of said lock retainer and said receiver comprising a generally correspondingly shaped groove or channel, when said pin is received within said groove or channel said lock is in its locked position, when said pin is released from said groove or channel said lock is in its unlocked position.

5. The support post as claimed in claim 4 wherein said lock retainer comprises said pin and said receiver comprises said correspondingly shaped groove or channel.

6. The support post as claimed in claim 4 including a manual release member, when said lock in said locked position operation of said manual release member applying a force to said lock receiver disengage said lock receiver and said lock retainer causing said lock to move from said locked to said unlocked position.

7. The support post as claimed in claim 3 wherein said latch is pivotally mounted within said first elongate member.

8. The support post as claimed in claim 7 wherein said latch includes a knife-edge, when said floor engaging member is positioned against a floor structure with said lock in said unlocked position and said spring biasing said ceiling engaging member into contact with a ceiling structure, said knife-edge engaging said second elongate member to limit movement of said first elongate member relative to said second elongate member.

9. The support post as claimed in claim 7 wherein said latch includes a ring member, at least a portion of said ring member exterior to said first elongate member and receivable about at least a portion of the exterior of said second elongate member, when said lock in said unlocked position and said spring biasing said ceiling engaging member in contact with a ceiling structure, said ring member engaging at least a portion of the exterior of said second elongate member to limit telescopic movement of said first elongate member relative to said second elongate member.

10. The support post as claimed in claim 9 wherein said latch includes a latch spring, said latch spring biasing said ring member to engage at least a portion of the exterior of said second elongate member.

11. In combination, a support post as claimed in claim 1 and a fence panel, said first elongate member telescopically received about at least a portion of said second elongate member, said second elongate member comprising a portion of said fence panel such that securing said support post between a ceiling structure and a floor structure causes the fence panel to be secured between the ceiling structure and the floor structure.

12. A support post for releasably securing between a ceiling structure and a floor structure, the support post comprising:

a first elongate member telescopically mounted to a second elongate member that comprises a portion of a fence panel, wherein said first elongate member is generally tubular with at least a partially hollow interior, a ceiling engaging member positioned at the upper end of said first elongate member and a floor engaging member positioned at the lower end of said second elongate member, a spring biasing said ceiling engaging member in a direction away from said upper end of said first elongate member, a lock positioned with the hollow interior of said first elongate member, wherein, when said lock is in a locked position said lock maintains said spring in a compressed configuration and when said lock is in an unlocked position, said lock releases said spring from its compressed configuration and permits said spring to apply a biasing force to said ceiling engaging member urging said ceiling engaging member away from said upper end of said first elongate member, and a latch, said latch allowing for the telescopic movement of said first elongate member relative to said second elongate member when said lock is in said locked position, said latch resisting the telescopic movement of said first elongate member relative to said second elongate member when said lock is in its unlocked position.

13. A support post for releasably securing between two rigid or semi-rigid structures, the support post comprising:

first and second elongate members, said first elongate member having at least a partially hollow interior, said first and second members telescopically engaged, said first elongate member having a first structural engaging member and said second elongate member having a second structural engaging member, a spring biasing said first structural engaging member in a direction away from the outer end of said first elongate member, a lock, having a locked and an unlocked position, when in its locked position said lock maintaining said spring in a compressed configuration and when in its unlocked position said lock releasing said spring from its compressed configuration and permitting said spring to apply a biasing force to at least one of said first and second structural engaging members urging said at least one structural engaging member away from its respective elongate member, and a latch, at least a portion of said latch received within the hollow interior of said first elongate member, said latch operatively secured to one of said first and second elongate members, said latch allowing for the telescopic movement of said elongate members relative to one another when said lock is in said locked position, said latch resisting the telescopic movement of said elongate members relative to one another when said lock is in said unlocked position.

14. The support post as claimed in claim 13 wherein said spring and said lock are positioned within the hollow interior of said first elongate member.

15. A support post for releasably securing between a ceiling structure and a floor structure, the support post comprising:

first and second elongate members, said first elongate member generally tubular with at least a partially hollow interior, said second elongate member telescopically engaged with at least a portion of said first elongate member, a ceiling engaging member positioned at the upper end of said first elongate member and a floor engaging member positioned at the lower end of said second elongate member, a spring biasing said ceiling engaging member in a direction away from said upper end of said first elongate member, a lock, when in its locked position said lock maintaining said spring in a compressed configuration and when in its unlocked position said lock releasing said spring from its compressed configuration and permitting said spring to apply a biasing force to said ceiling engaging member urging said ceiling engaging member away from said upper end of said first elongate member, a latch operatively secured to said first elongate member, said latch allowing for the telescopic movement of said first elongate member relative to said second elongate member when said lock is in said locked position, said latch engaging said second elongate member when said lock is in said unlocked position and resisting the telescopic movement of said first elongate member relative to said second elongate member at least a portion of one of said lock and said latch positioned within the hollow interior of said first elongate member.

16. The support post as claimed in claim 15 wherein said spring and said lock are positioned within the hollow interior of said first elongate member.

17. The support post as claimed in claim 15 wherein said latch is positioned within the hollow interior of said first elongate member.

* * * * *